US009308621B2

(12) United States Patent
Fukushima et al.

(10) Patent No.: US 9,308,621 B2
(45) Date of Patent: Apr. 12, 2016

(54) METHOD AND APPARATUS FOR POLISHING A SUBSTRATE

(75) Inventors: Makoto Fukushima, Tokyo (JP); Tetsuji Togawa, Tokyo (JP); Shingo Saito, Tokyo (JP); Tomoshi Inoue, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 848 days.

(21) Appl. No.: 13/057,605

(22) PCT Filed: Aug. 7, 2009

(86) PCT No.: PCT/JP2009/064319

§ 371 (c)(1),
(2), (4) Date: Mar. 14, 2011

(87) PCT Pub. No.: WO2010/021297

PCT Pub. Date: Feb. 25, 2010

(65) Prior Publication Data

US 2011/0159783 A1 Jun. 30, 2011

(30) Foreign Application Priority Data

Aug. 21, 2008 (JP) ..... 2008-213064

(51) Int. Cl.
*B24B 49/10* (2006.01)
*B24B 49/16* (2006.01)
(Continued)

(52) U.S. Cl.
CPC ..... *B24B 37/32* (2013.01); *B24B 37/005* (2013.01); *B24B 37/042* (2013.01); *B24B 49/10* (2013.01); *B24B 49/12* (2013.01)

(58) Field of Classification Search
CPC ..... B24B 49/08; B24B 49/10; B24B 49/12; B24B 49/16; B24B 49/18; B24B 37/005; B24B 37/042; B24B 37/10; B24B 37/30; B24B 37/32
USPC ..... 451/9, 10, 11, 14, 41, 285, 287, 288, 451/290
See application file for complete search history.

(56) References Cited

U.S. PATENT DOCUMENTS 5,036,015 A * 7/1991 Sandhu et al. ..... 438/14
6,273,803 B1 * 8/2001 Wang et al. ..... 451/288
(Continued)

FOREIGN PATENT DOCUMENTS

JP 08-229807 9/1996
JP 2000-077368 3/2000
(Continued)

OTHER PUBLICATIONS

International Search Report issued Nov. 17, 2009 in International (PCT) Application No. PCT/JP2009/064319.

*Primary Examiner* — Eileen Morgan
(74) *Attorney, Agent, or Firm* — Wenderoth, Lind & Ponack, L.L.P.

(57) ABSTRACT

A polishing method is used for polishing a substrate such as a semiconductor wafer to a flat mirror finish. A method of polishing a substrate by a polishing apparatus includes a polishing table (100) having a polishing surface, a top ring (1) for holding a substrate and pressing the substrate against the polishing surface, and a vertically movable mechanism (24) for moving the top ring (1) in a vertical direction. The top ring (1) is moved to a first height before the substrate is pressed against the polishing surface, and then the top ring (1) is moved to a second height after the substrate is pressed against the polishing surface.

30 Claims, 30 Drawing Sheets

(51) Int. Cl.

| | |
|---|---|
| ***B24B 37/005*** | (2012.01) |
| ***B24B 37/32*** | (2012.01) |
| ***B24B 37/04*** | (2012.01) |
| ***B24B 49/12*** | (2006.01) |

(56) References Cited

U.S. PATENT DOCUMENTS

| | | | | |
|---|---|---|---|---|
| 6,273,804 | B1 * | 8/2001 | Numoto | 451/288 |
| 6,361,420 | B1 * | 3/2002 | Zuniga et al. | 451/288 |
| 6,652,362 | B2 * | 11/2003 | Boo et al. | 451/41 |
| 6,840,846 | B2 | 1/2005 | Boo et al. | |
| 7,044,832 | B2 | 5/2006 | Yilmaz et al. | |
| 7,217,175 | B2 * | 5/2007 | Togawa | 451/63 |
| 7,445,543 | B2 | 11/2008 | Torii et al. | |
| 7,527,271 | B2 * | 5/2009 | Oh et al. | 279/3 |
| 7,645,185 | B2 | 1/2010 | Isobe et al. | |
| 2002/0098780 | A1 * | 7/2002 | Boo et al. | 451/41 |
| 2004/0180610 | A1 * | 9/2004 | Togawa | 451/41 |
| 2006/0148382 | A1 * | 7/2006 | Hayama | B24B 37/30 451/8 |
| 2007/0232193 | A1 | 10/2007 | Yasuda et al. | |

FOREIGN PATENT DOCUMENTS

| | | |
|---|---|---|
| JP | 2001-138224 | 5/2001 |
| JP | 2002-113653 | 4/2002 |
| JP | 2002-198337 | 7/2002 |
| JP | 2004-327547 | 11/2004 |
| JP | 2005-123485 | 5/2005 |
| JP | 2005-199388 | 7/2005 |
| JP | 2006-128582 | 5/2006 |
| JP | 2007-268654 | 10/2007 |
| JP | 2007-276110 | 10/2007 |
| JP | 2008-132592 | 6/2008 |
| KR | 2002-0040529 | 5/2002 |

* cited by examiner definition of membrane height
-10kPa
-80kPa
1
3
4
W
101
lifting top ring
by 0.5 mm higher
than FIG. 4A
(membrane height
= 0.5 mm)

-10kPa
-80kPa
1
3
4
W
101
0.5mm
pressurizing membrane
from FIG. 4B 1
2
3
4
W
101
0.5mm at time of vacuum-chucking wafer
before lowering top ring lowering top ring
(state of vacuum-chucking wafer,
before application of pressure) :
in state of large clearance
between wafer and pad (high MH)

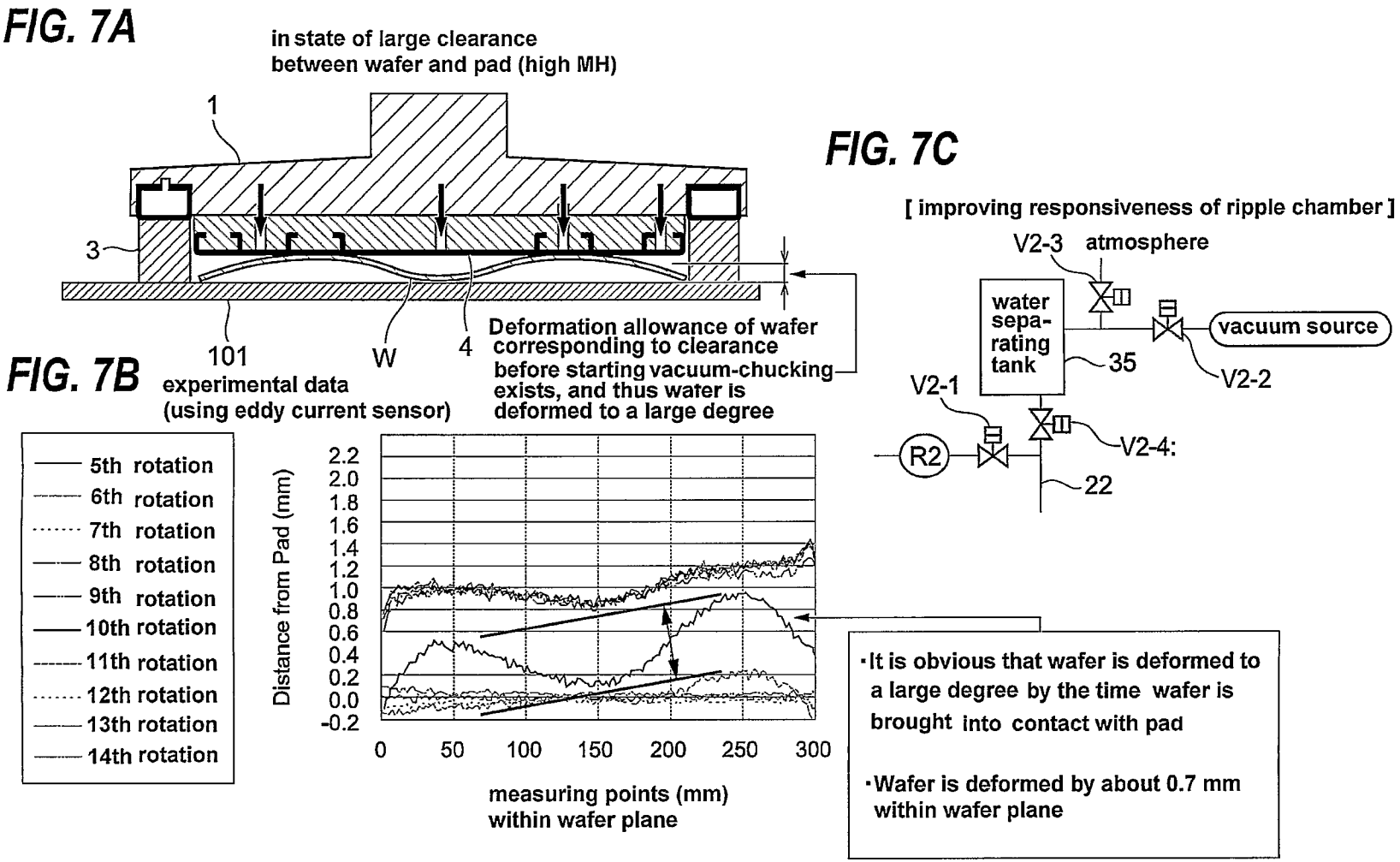
FIG. 7A
in state of large clearance between wafer and pad (high MH)
1
3
4
W
101
Deformation allowance of wafer corresponding to clearance before starting vacuum-chucking exists, and thus wafer is deformed to a large degree
FIG. 7B
experimental data (using eddy current sensor)
Distance from Pad (mm)
2.2
2.0
1.8
1.6
1.4
1.2
1.0
0.8
0.6
0.4
0.2
0.0
-0.2
0
50
100
150
200
250
300
measuring points (mm) within wafer plane
5th rotation
6th rotation
7th rotation
8th rotation
9th rotation
10th rotation
11th rotation
12th rotation
13th rotation
14th rotation
FIG. 7C
[ improving responsiveness of ripple chamber ]
atmosphere
V2-3
water separating tank
35
vacuum source
V2-2
V2-1
R2
V2-4
22
·It is obvious that wafer is deformed to a large degree by the time wafer is brought into contact with pad
·Wafer is deformed by about 0.7 mm within wafer plane lowering top ring
(state of vacuum-chucking wafer,
before application of pressure) :
in state of small clearance
between wafer and pad ( low MH) (present invention 1)

substantial polishing:
moving height of top ring lowering top ring
(state of vacuum-chucking wafer,
before application of pressure) :
in state of large clearance
between wafer and pad (high MH) (present invention 2)

applying pressure at substantial polishing pressure without moving height (present invention 2)

height of top ring at time of starting vacuum-chucking:
in case of large clearance between
surface of carrier and rear surface of membrane
(high MH)

FIG. 16A polishing pad with grooves

FIG. 16B polishing pad with no grooves height of top ring at time of starting vacuum-chucking:
in case of small clearance between
surface of carrier and rear surface of membrane ( low MH) (present invention)

starting vacuum-chucking:
in case of small clearance between
surface of carrier and rear surface of membrane (low MH) (present invention)

completing vacuum-chucking:
in case of small clearance between
surface of carrier and rear surface of membrane ( low MH) (present invention)
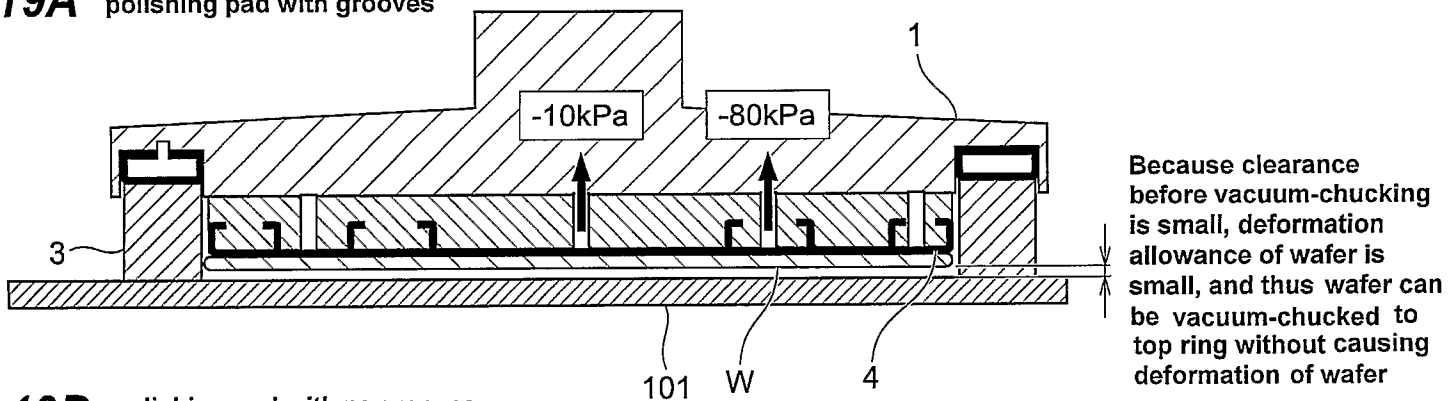
FIG. 19A polishing pad with grooves
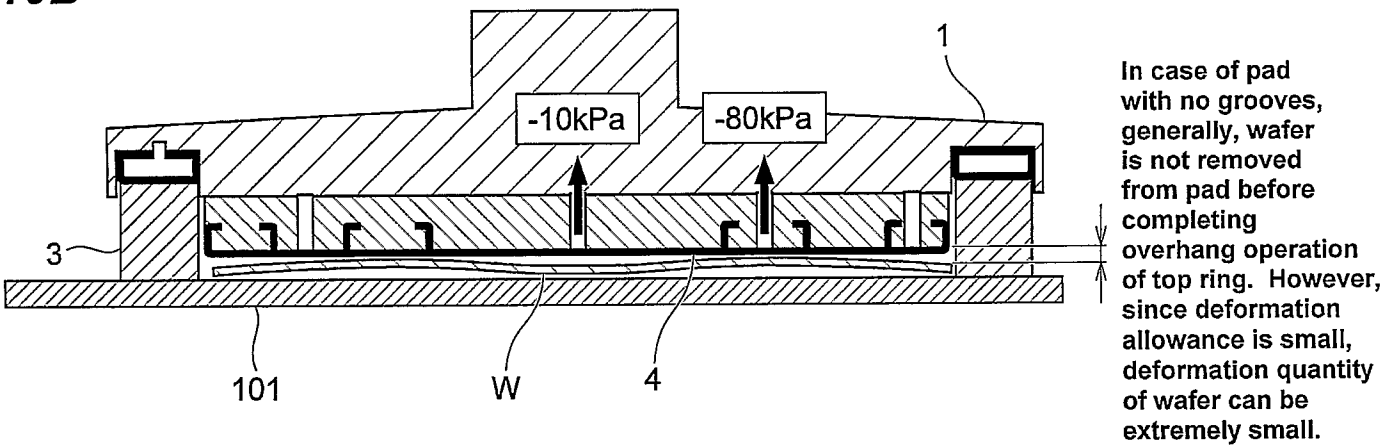
FIG. 19B polishing pad with no grooves experimental data:
relationship between membrane height (clearance between lower surface of carrier and upper surface of membrane) at time of vacuum-chucking wafer and stress applied to wafer at time of vacuum-chucking wafer

METHOD AND APPARATUS FOR POLISHING A SUBSTRATE

TECHNICAL FIELD

The present invention generally relates to a polishing method and apparatus, and more particularly to a polishing method and apparatus for polishing an object to be polished (substrate) such as a semiconductor wafer to a flat mirror finish.

BACKGROUND ART

In recent years, high integration and high density in semiconductor device demands miniaturization of wiring patterns or interconnections and also increase of the number of interconnection layers in the device. The trend for the device having multilayered interconnections in smaller circuits generally widens the width of steps due to the surface irregularities on lower interconnection layers, resulting in degradation of flatness. An increase in the number of interconnection layers could worsen a quality of film coating (step coverage) over stepped configurations in the process of forming thin films. In summary, firstly, the advent of highly-layered multilayer interconnections necessitates the new planarization process capable of attaining improved step coverage and proper surface accordingly. Secondly, this trend and another reason as described below need a new process capable of planarizing a surface of the semiconductor device: a surface of the semiconductor device needs to be planarized such that irregular steps on the surface of the semiconductor device will fall within the depth of focus. Therefore, the smaller the depth of focus of a photolithographic optical system with miniaturization of a photolithographic process becomes, the more precisely flattened surface after planarization process is needed.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding apparatus, which is referred to as a top ring or a polishing head, for holding a substrate such as a semiconductor wafer. When a semiconductor wafer is polished with such a polishing apparatus, the semiconductor wafer is held and pressed against the polishing surface of the polishing pad under a predetermined pressure by the substrate holding apparatus. At this time, the polishing table and the substrate holding apparatus are moved relative to each other to bring the semiconductor wafer into sliding contact with the polishing surface, so that the surface of the semiconductor wafer is polished to a flat mirror finish.

Conventionally, as a substrate holding apparatus, there has been widely used a so-called floating-type top ring in which an elastic membrane (membrane) is fixed to a chucking plate, and a fluid such as air is supplied to a pressure chamber (pressurizing chamber) formed above the chucking plate and a pressure chamber formed by the elastic membrane (membrane) to press a semiconductor wafer against a polishing pad under a fluid pressure through the elastic membrane. In the floating-type top ring, the chucking plate is floated by a balance between a pressure of the pressurizing chamber above the chucking plate and a pressure of the membrane below the chucking plate so as to press the substrate onto the polishing surface in an appropriate pressing force, thereby polishing the semiconductor wafer. In this top ring, when application of the pressure to the semiconductor wafer is started or vacuum-chucking of the semiconductor wafer is performed after polishing, the following operation is carried out:

When application of the pressure to the semiconductor wafer is started, the pressurizing chamber is pressurized, the chucking plate which holds the semiconductor wafer by the membrane is lowered to bring the polishing pad, the semiconductor wafer and the membrane into close contact with each other. Then, a desired pressure is applied to the membrane, and thereafter or simultaneously, the pressure of the pressurizing chamber is regulated to be not greater than the membrane pressure, thereby allowing the chucking plate to float. In this state, the semiconductor wafer is polished. In this case, the reason why the chucking plate is first lowered to bring the polishing pad, the semiconductor wafer and the membrane into close contact with each other is that a pressurized fluid between the semiconductor wafer and the membrane should be prevented from leaking. If pressure is applied to the membrane in a state in which the polishing pad, the semiconductor wafer and the membrane are not brought into close contact with each other, a gap is produced between the semiconductor wafer and the membrane, and the pressurized fluid leaks through the gap.

Further, if the pressure of the pressurizing chamber is not less than the membrane pressure at the time of polishing, the chucking plate presses the semiconductor wafer locally, and a thin film on the semiconductor wafer is polished excessively in local regions thereof. Therefore, the pressure of the pressurizing chamber is regulated to be not more than the membrane pressure, thereby allowing the chucking plate to float. Then, after polishing, at the time of vacuum-chucking of the semiconductor wafer, the pressurizing chamber is pressurized to lower the chucking plate, and the polishing pad, the semiconductor wafer and the membrane are brought into close contact with each other. In this state, the semiconductor wafer is vacuum-chucked to the membrane by creating vacuum above the membrane.

As described above, in the floating-type top ring having the chucking plate, when application of the pressure to the semiconductor wafer is started, or the semiconductor wafer is vacuum-chucked to the membrane after polishing, it is necessary to control a vertical position of the chucking plate by the balance between the pressure of the pressurizing chamber and the membrane pressure. However, in use of this floating-type top ring, because the pressure balance controls the position of the chucking plate, it is difficult to control the vertical position of the chucking plate precisely in the level of required for a recent fabrication process of highly miniaturized and multilayered device. Further, the pressurizing chamber having a large volume requires sufficiently long time when application of the pressure to the semiconductor wafer is started or the semiconductor wafer is vacuum-chucked after polishing due to prolongation of inflation or deflation process of the chamber, and there is a lower limit for a volume of chamber for an appropriated balancing as described above. This is thought to impede an improvement in productivity of the polishing apparatus. Further, in the floating-type top ring, as wear of the retainer ring progresses, the distance between the polishing surface and the lower surface of the chucking plate is shortened, and the amount of expansion and contraction of the membrane in the vertical direction varies locally, thus causing variation of the polishing profile.

Therefore, recently, a top ring which has an improved controllability of a vertical position of a carrier (top ring body), as a supporting member of a membrane, from a polishing surface in precise level has been used as an alternative. A vertical motion of the top ring is usually performed by a servomotor and a ball screw, and thus it is possible to position the carrier (top ring body) instantly at a predetermined height. This shortens a time for an operation in relative to the conventional top ring when application of the pressure to the semiconductor wafer is started or the semiconductor wafer is vacuum-chucked after polishing, and hence it is possible to improve productivity of the polishing apparatus in relative to floating-type top ring. Further, in this top ring, i.e. membrane type top ring, because the vertical position of the carrier from the polishing surface can be controlled precisely, the polishing profile of the edge portion of the semiconductor wafer can be adjusted not by balancing such as floating-type top ring but by regulating the expansion of the membrane. Further, since the retainer ring can be moved vertically independently of the carrier, even if the retainer ring is worn, the vertical position of the carrier from the polishing surface is not affected. Accordingly, lifetime of the retainer ring can be prolonged dramatically.

In this type of top ring, when application of the pressure to the semiconductor wafer is started or the semiconductor wafer is vacuum-chucked after polishing, the following operation is normally performed:

When application of the pressure to the semiconductor wafer is started, the carrier, or top ring which holds the semiconductor wafer under vacuum by the membrane is lowered onto the polishing pad. At this time, the top ring is moved to the height where a desired polishing profile can be obtained in the subsequent polishing process. Normally, in the membrane-type top ring having good elasticity, since the peripheral portion (edge portion) of the semiconductor wafer is liable to be polished, it is desirable that the pressure applied to the semiconductor wafer should be reduced by a loss caused by expansion of the membrane by raising the height of the top ring. Specifically, the top ring is lowered to the height where the gap between the semiconductor wafer and the polishing pad is about 1 mm, typically. Thereafter, the semiconductor wafer is pressed against the polishing surface and is polished. After polishing, the semiconductor wafer is vacuum-chucked to the top ring while the top ring remains the same height as that of polishing. However, the conventional polishing method thus conducted has the following problems unforeseen at first.

A gap between the semiconductor wafer and the polishing pad when application of the pressure to the semiconductor wafer is started may result in deformation of the semiconductor wafer. This deformation could be reached to a large degree, in proportion to a quantity corresponding to the gap between the semiconductor wafer and the polishing pad. Therefore, stress applied to the semiconductor wafer increases in such case, resulting in increase of breakage of fine interconnections formed on the semiconductor wafer or damage of the semiconductor wafer itself. On the other hand, when the semiconductor wafer is vacuum-chucked after polishing, if the semiconductor wafer is attached to the carrier by creating vacuum above the membrane from the state in which there is a gap between the lower surface of the carrier and the upper surface of the membrane, then the deformation quantity of the semiconductor wafer becomes larger by a quantity corresponding to the gap between the lower surface of the carrier and the upper surface of the membrane. Therefore, stress applied to the semiconductor wafer increases and the semiconductor wafer is damaged in some cases in operation of membrane-type top ring. However, a challenge to avoid such defect has not been successful so far. Firstly, to form no gap is not successful: when pressure is applied to the semiconductor wafer or the semiconductor wafer is vacuum-chucked, if the top ring is lowered to the position where there is almost no gap between the semiconductor wafer and the polishing pad or the semiconductor wafer is brought into contact with the polishing pad locally, then a thin film on the semiconductor wafer is polished excessively or the semiconductor wafer itself is damaged at the worst.

Secondly, a release nozzle disclosed in Japanese laid-open patent publication No. 2005-123485, having been used to reduce stress applied to the semiconductor wafer when the semiconductor wafer is released from the top ring, can be thought to be alternative. The release nozzle serves as an assisting mechanism for assisting the release of the semiconductor wafer from the top ring by ejecting a pressurized fluid between the rear surface of the semiconductor wafer and the membrane. In this case, the semiconductor wafer is pushed out downwardly from the bottom surface of the retainer ring to remove the peripheral portion of the semiconductor wafer from the membrane, and then the pressurized fluid is ejected between the peripheral portion of the semiconductor wafer and the membrane. Therefore, when the semiconductor wafer is released from the top ring, it is necessary to inflate the membrane by pressuring the membrane, as seen in Japanese laid-open patent publication No. 2005-123485. The release nozzle is also disclosed in U.S. Pat. No. 7,044,832. As disclosed in this U.S. patent publication, when the semiconductor wafer is released, the bladder is inflated (pressurized), and then a shower is sprayed in a state in which the edge portion of the semiconductor wafer is separated from the bladder (see the $6^{th}$ to $15^{th}$ lines of the column 10 and FIG. 2A). Specifically, in both of the above publications, the membrane is inflated to separate the edge portion of the semiconductor wafer from the membrane, and a shower is sprayed into the gap. However, when the membrane in these publications is pressurized and inflated as suggested, locally varied downforce is applied to the substrate. Accordingly, stress tends to be applied to the semiconductor wafer locally in accordance with inflation of membrane, and fine interconnections formed on the semiconductor wafer are broken or the semiconductor wafer itself is damaged at the worst in use of these conventional top rings having nozzle. There needs a planarization process for attaining both of precise flatness and high-throughput, with reduced defect of a substrate due to the planarization process.

DISCLOSURE OF INVENTION

The present invention has been made in view of the above drawbacks. It is therefore an object of the present invention to provide a polishing method and apparatus which can attain a high through-put, reduce deformation of a substrate such as a semiconductor wafer and stress applied to the substrate to prevent generation of a defect of the substrate or damage of the substrate, thereby polishing the substrate, vacuum-chucking the substrate to the top ring and releasing the substrate from the top ring in a safe manner.

In order to achieve the above object, according to a first aspect of the present invention, there is provided a method of polishing a substrate by a polishing apparatus comprising: a polishing table having a polishing surface, a top ring for holding a substrate and pressing the substrate against the polishing surface, and a vertically movable mechanism for moving the top ring in a vertical direction, the method comprising: moving the top ring to a first height before the substrate is pressed against the polishing surface; and moving the top ring to a second height after the substrate is pressed against the polishing surface.

According to the first aspect of the present invention, before the substrate such as a semiconductor wafer is pressed against the polishing surface of the polishing table, the top ring is lowered to the first height at which a clearance between the substrate and the polishing surface is small. When the top ring is located at the first height, application of the pressure is started and the substrate is brought into contact with the polishing surface and pressed against the polishing surface. Because the clearance between the substrate and the polishing surface is small at the time of starting application of the pressure, deformation allowance of the substrate can be small, and thus the deformation of the substrate can be suppressed. Thereafter, the top ring is moved to the desired second height.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and the first height is equivalent to a membrane height which is in the range of 0.1 mm to 1.7 mm, the membrane height being defined as a clearance between the substrate and the polishing surface in a state in which the substrate is attached to and held by the membrane.

In a state in which the substrate is attached to and held by the top ring (hereinafter referred also to as "the substrate is vacuum-chucked to the top ring") before the substrate is pressed against the polishing surface, the clearance between the substrate and the polishing surface becomes the membrane height.

In a preferred aspect of the present invention, the first height is equivalent to a membrane height which is in the range of 0.1 mm to 0.7 mm, the membrane height being defined as a clearance between the substrate and the polishing surface in a state in which the substrate is attached to and held by the membrane.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and the second height is equivalent to a membrane height which is in the range of 0.1 mm to 2.7 mm, the membrane height being defined as a clearance between the top ring body and the membrane in a state in which the substrate is pressed against the polishing surface by the membrane.

In a state in which the substrate is pressed against the polishing surface, the membrane height, i.e. a clearance between the membrane and the top ring (carrier) becomes "second height." A more precise controller is necessary in order to make the membrane height not more than 1 mm, and it makes little sense to make the membrane height not more than 1 mm because such height is within a possible error range in a planarization process. Further, in the case of making the membrane height not less than 2.7 mm, it has been found that it is impossible or insufficient to accomplish adequate global planarization. Thus, it is desirable that the membrane height is in the range of 0.1 mm to 2.7 mm.

In a preferred aspect of the present invention, the second height is equivalent to a membrane height which is in the range of 0.1 mm to 1.2 mm, the membrane height being defined as a clearance between the top ring body and the membrane in a state in which the substrate is pressed against the polishing surface by the membrane.

In a preferred aspect of the present invention, the method further comprises a step of detecting a pressing of the substrate against the polishing surface.

In a preferred aspect of the present invention, the top ring is moved to the second height after detecting the pressing of the substrate against the polishing surface.

In a preferred aspect of the present invention, at least one of current value change of a motor for rotating the polishing table, an eddy current sensor provided in the polishing table, an optical sensor provided in the polishing table, and current value change of a motor for rotating the top ring is used so as to detect the pressing of the substrate against the polishing surface.

In a preferred aspect of the present invention, the vertically movable mechanism for moving the top ring in a vertical direction comprises a ball screw and a motor for rotating the ball screw; and current value change of the motor for rotating the ball screw is used so as to detect the pressing of the substrate against the polishing surface.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and pressure change or flow rate change of the pressurized fluid supplied to the pressure chamber is used so as to detect the pressing of the substrate against the polishing surface.

According to a second aspect of the present invention, there is provided a method of polishing a substrate by a polishing apparatus comprising: a polishing table having a polishing surface, a top ring for holding a substrate and pressing the substrate against the polishing surface, and a vertically movable mechanism for moving the top ring in a vertical direction, the method comprising: moving the top ring to a predetermined height before the substrate is pressed against the polishing surface; pressing the substrate against the polishing surface at a first pressure while maintaining the top ring at the predetermined height; and polishing the substrate by pressing the substrate against the polishing surface at a second pressure higher than the first pressure after pressing the substrate against the polishing surface at the first pressure.

According to the second aspect of the present invention, before the substrate is pressed against the polishing surface of the polishing table, the top ring is lowered to a predetermined height. When the top ring is positioned at the predetermined height, application of the pressure is started at the first pressure to bring the substrate into contact with the polishing surface, and the substrate is pressed against the polishing surface. Specifically, at the time of starting application of the pressure, the substrate is pressurized at the first pressure of a low pressure to bring the substrate into contact with the polishing surface, thereby making the deformation quantity of the substrate smaller by the time the substrate is brought into contact with the polishing surface. Thereafter, the substrate is pressed against the polishing surface at the second pressure higher than the first pressure, thereby performing substantial polishing process for polishing the substrate. The substantial polishing process is referred to as a process of polishing for over twenty seconds, and plural substantial polishing processes may exist. During this substantial process, a polishing liquid or chemical liquid is supplied onto the polishing pad, the substrate is pressed against the polishing surface and brought into sliding contact with the polishing surface, thereby polishing the substrate or cleaning the substrate. The first pressure is preferably in the range of 50 hPa to 200 hPa, and more preferably approximately 100 hPa. The first pressure should be an optimum pressure which enables the membrane to be pressurized downwardly so that the substrate is brought into contact with the polishing surface while the top ring is maintained at a constant height. However, pressurization speed becomes slow at a pressure of not more than 50 hPa, and the substrate is pressurized more than necessary at a pressure of not less than 200 hPa and is thus deformed by the time the substrate is brought into contact with the polishing surface. The second pressure is in the range of 10 hPa to 1000 hPa, and preferably 30 hPa to 500 hPa. This range should be determined in consideration of the surface conditions, i.e. smoothness, and a material of the substrate or wafer.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and the predetermined height is equivalent to a membrane height which is in the range of 0.1 mm to 2.7 mm, the membrane height being defined as a clearance between the substrate and the polishing surface in a state in which the substrate is attached to and held by the membrane.

In a preferred aspect of the present invention, the predetermined height is equivalent to a membrane height which is in the range of 0.1 mm to 1.2 mm, the membrane height being defined as a clearance between the substrate and the polishing surface in a state in which the substrate is attached to and held by the membrane.

In a preferred aspect of the present invention, the first pressure is not more than half of the second pressure in the polishing process.

In a preferred aspect of the present invention, the first pressure is an atmospheric pressure.

In a preferred aspect of the present invention, the method further comprises a step of detecting the pressing of the substrate against the polishing surface.

In a preferred aspect of the present invention, the top ring is pressed against the polishing surface at the second pressure after detecting the pressing of the substrate against the polishing surface.

In a preferred aspect of the present invention, at least one of current value change of a motor for rotating the polishing table, an eddy current sensor provided in the polishing table, an optical sensor provided in the polishing table, and current value change of a motor for rotating the top ring is used so as to detect the pressing of the substrate against the polishing surface.

In a preferred aspect of the present invention, the vertically movable mechanism for moving the top ring in a vertical direction comprises a ball screw and a motor for rotating the ball screw; and current value change of the motor for rotating the ball screw is used so as to detect the pressing of the substrate against the polishing surface.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and pressure change or flow rate change of the pressurized fluid supplied to the pressure chamber is used so as to detect the pressing of the substrate against the polishing surface.

According to a third aspect of the present invention, there is provided a method of polishing a substrate by a polishing apparatus comprising: a polishing table having a polishing surface, a top ring for holding a substrate and pressing the substrate against the polishing surface, and a vertically movable mechanism for moving the top ring in a vertical direction, the method comprising: moving the top ring to a predetermined height before the substrate is pressed against the polishing surface; pressing the substrate at a predetermined pressure to bring the substrate into contact with the polishing surface while maintaining the top ring at the predetermined height; and detecting the contact of the substrate with the polishing surface at the time of starting polishing, and changing the polishing condition to a next polishing condition.

According to the third aspect of the present invention, before the substrate is pressed against the polishing surface of the polishing table, the top ring is lowered to a predetermined height. When the top ring is located at the predetermined height, application of the pressure to the substrate is started at the predetermined pressure and the substrate is brought into contact with the polishing surface. At the time of starting polishing, the contact of the substrate with the polishing surface is detected, and the polishing condition is changed to a next polishing condition such that a polishing pressure for pressing the substrate against the polishing surface is changed to a desired value or the top ring is elevated to a desired height.

In a preferred aspect of the present invention, at least one of current value change of a motor for rotating the polishing table, an eddy current sensor provided in the polishing table, an optical sensor provided in the polishing table, and current value, change of a motor for rotating the top ring is used so as to detect the contact of the substrate with the polishing surface.

In a preferred aspect of the present invention, the vertically movable mechanism for moving the top ring in a vertical direction comprises a ball screw and a motor for rotating the ball screw; and current value change of the motor for rotating the ball screw is used so as to detect the contact of the substrate with the polishing surface.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and pressure change or flow rate change of the pressurized fluid supplied to the pressure chamber is used so as to detect the contact of the substrate with the polishing surface.

According to a fourth aspect of the present invention, there is provided a method of polishing a substrate by a polishing apparatus comprising: a polishing table having a polishing surface, a top ring for holding a substrate and pressing the substrate against the polishing surface, and a vertically movable mechanism for moving the top ring in a vertical direction, the method comprising: moving the top ring to a predetermined height in a state in which the substrate is brought in contact with the polishing surface; and attaching the substrate to the top ring from the polishing surface and holding the substrate by the top ring after moving the top ring or simultaneously with moving the top ring.

According to the fourth aspect of the present invention, after completing the substrate processing on the polishing surface and when the substrate is vacuum-chucked to the top ring, the top ring is moved, and vacuum-chucking of the substrate is started from the state in which there is a small clearance between the substrate holding surface for vacuum-chucking the substrate and the surface of the top ring body (carrier). Accordingly, since the clearance before vacuum-chucking of the substrate is small, deformation allowance of the substrate is small, and thus the deformation quantity of the substrate can be extremely small.

In a preferred aspect of the present invention, the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and the predetermined height is equivalent to a membrane height which is in the range of 0.1 mm to 1.7 mm, the membrane height being defined as a clearance between the top ring body and the membrane in a state in which the substrate is pressed against the polishing surface by the membrane.

In a preferred aspect of the present invention, the predetermined height is equivalent to a membrane height which is in the range of 0.1 mm to 1.0 mm, the membrane height being defined as a clearance between the top ring body and the membrane in a state in which the substrate is pressed against the polishing surface by the membrane.

In a preferred aspect of the present invention, the vertically movable mechanism comprises a ball screw for moving the top ring in a vertical direction and a motor for rotating the ball screw.

In a preferred aspect of the present invention, the vertically movable mechanism comprises a mechanism including a sensor for measuring the height of the polishing surface.

According to a fifth aspect of the present invention, there is provided an apparatus for polishing a substrate comprising: a polishing table having a polishing surface; a top ring configured to hold a rear face of the substrate by a substrate holding surface and to hold an outer peripheral edge of the substrate by a retainer ring, and configured to press the substrate against the polishing surface; a vertically movable mechanism configured to move the top ring in a vertical direction; and a pusher configured to transfer the substrate to or from the top ring; wherein the pusher is capable of pushing a bottom surface of the retainer ring up to a position higher than the substrate holding surface before receiving the substrate from the top ring.

According to the fifth aspect of the present invention, the pusher is lifted before receiving the substrate from the top ring, and the bottom surface of the retainer ring is pushed by the pusher and is thus located at a vertical position higher than the substrate holding surface of the top ring. Therefore, a boundary between the substrate and the substrate holding surface is exposed. Then, for example, a pressurized fluid can be ejected between the substrate and the substrate holding surface so that the substrate is released. Thus, it is possible to reduce stress applied to the substrate at the time of releasing.

In a preferred aspect of the present invention, the top ring has a retainer ring chamber for being supplied with a pressurized fluid, the retainer ring chamber being configured to press the retainer ring against the polishing surface under a fluid pressure when the retainer ring chamber is supplied with the pressurized fluid; and the retainer ring chamber is connectable to a vacuum source.

In a preferred aspect of the present invention, the pusher comprises a nozzle for ejecting a pressurized fluid between the substrate holding surface and the substrate, and the substrate is removed from the substrate holding surface by the pressurized fluid ejected from the nozzle.

In a preferred aspect of the present invention, the top ring comprises at least one elastic membrane configured to form a plurality of pressure chambers for being supplied with a pressurized fluid, and a top ring body for holding the membrane, the membrane being configured to press the substrate against the polishing surface under a fluid pressure when the plurality of pressure chambers are supplied with the pressurized fluid; and when the substrate is removed from the membrane constituting the substrate holding surface, the substrate is removed in a state in which all of the plurality of pressure chambers are not pressurized.

According to the present invention, it is possible to remove the substrate only by the effect of the pressurized fluid from the nozzle of the pusher without pressurizing the membrane. Thus, stress applied to the substrate can be reduced.

According to a sixth aspect of the present invention, there is provided an apparatus for polishing a substrate comprising: a polishing table having a polishing surface; a top ring configured to hold a rear face of the substrate by a substrate holding surface and to hold an outer peripheral edge of the substrate by a retainer ring, and configured to press the substrate against the polishing surface; and a vertically movable mechanism configured to move the top ring in a vertical direction; wherein the top ring comprises at least one elastic membrane configured to form a plurality of pressure chambers for being supplied with a pressurized fluid, and a top ring body for holding the membrane, the membrane being configured to press the substrate against the polishing surface under a fluid pressure when the plurality of pressure chambers are supplied with the pressurized fluid; and wherein when the substrate is removed from the membrane constituting the substrate holding surface, at least one of the plurality of pressure chambers is pressurized and at least one of the plurality of pressure chambers is depressurized in a vacuum state.

According to the sixth aspect of the present invention, when the pressure chamber is pressurized in order to remove the substrate from the membrane, the membrane continues to be inflated to a large degree in a state in which the substrate adheres to the membrane, and thus stress applied to the substrate becomes large. Therefore, in the case where at least one of the pressure chambers is pressurized, in order to prevent the membrane from continuing to be inflated in a state in which the substrate adheres to the membrane, at least one of the pressure chambers other than the pressurized pressure chambers is depressurized to suppress inflation of the membrane.

According to a seventh aspect of the present invention, there is provided an apparatus for polishing a substrate comprising: a polishing table having a polishing surface; a top ring configured to hold a rear face of the substrate by a substrate holding surface and to hold an outer peripheral edge of the substrate by a retainer ring, and configured to press the substrate against the polishing surface; a vertically movable mechanism configured to move the top ring in a vertical direction; wherein the top ring comprises at least one elastic membrane configured to form a pressure chamber for being supplied with a pressurized fluid, and a top ring body for holding the membrane, the membrane being configured to press the substrate against the polishing surface under a fluid pressure when the pressure chamber is supplied with the pressurized fluid; and wherein the vertically movable mechanism is operable to move the top ring from a first position to a second position in a state in which the retainer ring is brought in contact with the polishing surface; the first position being defined as a position where there is a clearance between the substrate and the polishing surface in a state in which the substrate is attached to and held by the membrane; the second position being defined as a position where there is a clearance between the top ring body and the membrane in a state in which the substrate is pressed against the polishing surface by the membrane.

According to the seventh aspect of the present invention, before the substrate such as a semiconductor wafer is pressed against the polishing surface of the polishing table, the top ring is lowered to the first position at which a clearance between the substrate and the polishing surface is small. When the top ring is located at the first position, application of pressure is started and the substrate is brought into contact with the polishing surface and pressed against the polishing surface. Because the clearance between the substrate and the polishing surface is small at the time of starting the application of the pressure, deformation allowance of the substrate can be small, and thus the deformation of the substrate can be suppressed. Thereafter, the top ring is moved to the second position.

In a preferred aspect of the present invention, the apparatus further comprises a retainer ring guide fixed to the top ring body and configured to be brought into sliding contact with a ring member of the retainer ring to guide a movement of the ring member; and a connection sheet provided between the ring member and the retainer ring guide.

According to the present invention, the connection sheet serves to prevent a polishing liquid (slurry) from being introduced into the gap between the ring member and the retainer ring guide.

In a preferred aspect of the present invention, the apparatus further comprises a retainer ring chamber for being supplied with a pressurized fluid, the retainer ring chamber being configured to press the retainer ring against the polishing surface under a fluid pressure when the retainer ring chamber is supplied with the pressurized fluid, the retainer ring chamber being formed in a cylinder fixed to the top ring body; a retainer ring guide fixed to the top ring body and configured to be brought into sliding contact with a ring member of the retainer ring to guide a movement of the ring member; and a band comprising a belt-like flexible member provided between the cylinder and the retainer ring guide.

According to the present invention, the band serves to prevent a polishing liquid (slurry) from being introduced into the gap between the cylinder and the retainer ring guide.

In a preferred aspect of the present invention, the membrane includes a seal member which connects the membrane to the retainer ring at an edge of the membrane.

According to the present invention, the seal member serves to prevent the polishing liquid from being introduced into the gap between the elastic membrane and the ring member while allowing the top ring body and the retainer ring to be moved relative to each other.

In a preferred aspect of the present invention, the membrane is held on the lower surface of the top ring body by an annular edge holder disposed radially outward of the membrane and annular ripple holders disposed radially inward of the edge holder.

In a preferred aspect of the present invention, the ripple holder is held on the lower surface of the top ring body by a plurality of stoppers.

As described above, according to the present invention, when application of the pressure to the substrate is started to polish the substrate, the substrate is vacuum-chucked to the top ring, or the substrate is released from the top ring, deformation of the substrate can be suppressed and stress applied to the substrate can be reduced. As a result, generation of a defect of the substrate or damage of the substrate can be prevented, thereby polishing the substrate, vacuum-chucking the substrate to the top ring and releasing the substrate from the top ring in a safe manner.

The above and other objects, features, and advantages of the present invention will become apparent from the following description when taken in conjunction with the accompanying drawings which illustrate preferred embodiments of the present invention by way of example.

BRIEF DESCRIPTION OF DRAWINGS

FIG. 7A is a schematic view showing deformation state of the semiconductor wafer in the case where application of the pressure is started from the state of a large clearance between the semiconductor wafer and the polishing pad as shown in FIG. 6;

FIG. 7B is a graph showing deformation quantity of the semiconductor wafer in the case where application of the pressure is started from the state of a large clearance between the semiconductor wafer and the polishing pad;

FIG. 7C is a view showing a passage communicating with the ripple chamber as a means for improving the pressure responsiveness of the ripple chamber;

FIG. 19A is a schematic view showing the state in which vacuum-chucking of the wafer to the top ring has been completed and showing the case in which the polishing pad has grooves;

FIG. 19B is a schematic view showing the state in which vacuum-chucking of the wafer to the top ring has been completed and showing the case in which the polishing pad has no grooves;

BEST MODE FOR CARRYING OUT THE INVENTION

Figure 1:
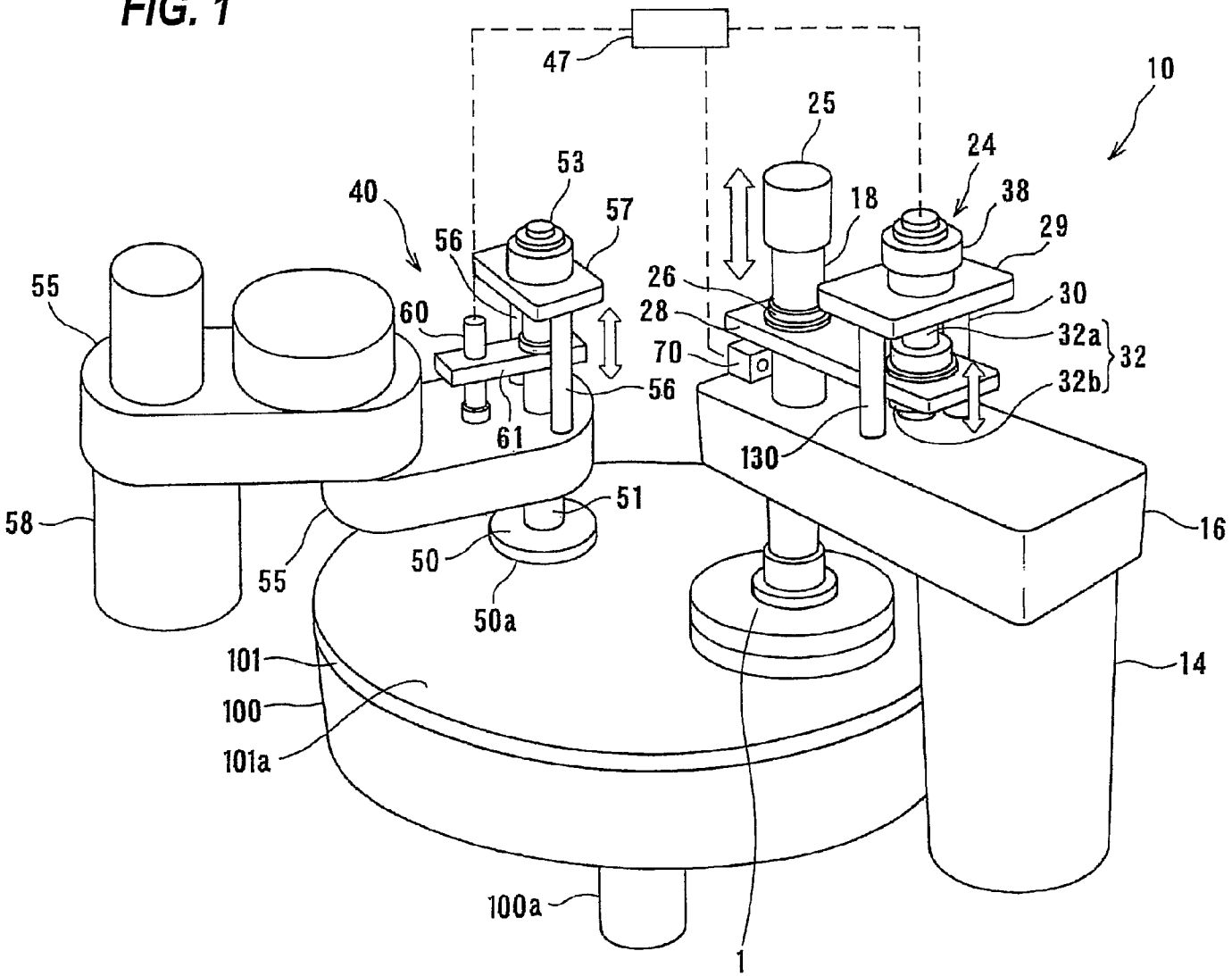
FIG. 1 is a schematic view showing an entire structure of a polishing apparatus according to an embodiment of the present invention.

A polishing apparatus according to embodiments of the present invention will be described below with reference to FIGS. 1 through 30. Like or corresponding parts are denoted by like or corresponding reference numerals throughout drawings and will not be described below repetitively.

FIG. 1 is a schematic view showing an entire structure of a polishing apparatus according to an embodiment of the present invention. As shown in FIG. 1, the polishing apparatus comprises a polishing table 100, and a top ring 1 constituting a polishing head for holding a substrate such as a semiconductor wafer as an object to be polished and pressing the substrate against a polishing surface on the polishing table 100.

The polishing table 100 coupled via a table shaft 100A to a motor (not shown) disposed below the polishing table 100. Thus, the polishing table 100 is rotatable about the table shaft 100A. A polishing pad 101 is attached to an upper surface of the polishing table 100. An upper surface 101*a* of the polishing pad 101 constitutes a polishing surface to polish a semiconductor wafer. A polishing liquid supply nozzle (not shown) is provided above the polishing table 100 to supply a polishing liquid onto the polishing pad 101 on the polishing table 100.

The top ring 1 is connected to a lower end of a top ring shaft 18, and the top ring shaft 18 is vertically movable with respect to a top ring head 16 by a vertically movable mechanism 24. When the vertically movable mechanism 24 moves the top ring shaft 18 vertically, the top ring 1 is lifted and lowered as a whole for positioning with respect to the top ring head 16. The top ring shaft 18 is rotatable by energizing a top ring rotating motor (not shown). The top ring 1 is rotatable about an axis of the top ring shaft 18 by rotation of the top ring shaft 18. A rotary joint 25 is mounted on the upper end of the top ring shaft 18.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring 1 is configured to hold a substrate such as a semiconductor wafer on its lower surface. The top ring head 16 is pivotable (swingable) about a top ring head shaft 114. Thus, the top ring 1, which holds a semiconductor wafer on its lower surface, is moved between a position at which the top ring 1 receives the semiconductor wafer and a position above the polishing table 100 by pivotal movement of the top ring head 16. The top ring 1 is lowered to press the semiconductor wafer against a surface (polishing surface) 101*a* of the polishing pad 101. At this time, while the top ring 1 and the polishing table 100 are respectively rotated, a polishing liquid is supplied onto the polishing pad 101 from the polishing liquid supply nozzle (not shown), which is provided above the polishing table 100. The semiconductor wafer is brought into sliding contact with the polishing surface 101*a* on the polishing pad 101. Thus, a surface of the semiconductor wafer is polished.

The vertical movement mechanism 24, which vertically moves the top ring shaft 18 and the top ring 1, has a bridge 28 supporting the top ring shaft 18 in a manner such that the top ring shaft 18 is rotatable via a bearing 26, a ball screw 32 mounted on the bridge 28, a support stage 29 which is supported by poles 130, and an AC servomotor 38 provided on the support stage 29. The support stage 29, which supports the servomotor 38, is fixed to the top ring head 16 via the poles 130.

The ball screw 32 has a screw shaft 32*a* which is coupled to the servomotor 38, and a nut 32*b* into which the screw shaft 32*a* is threaded. The top ring shaft 18 is configured to be vertically movable together with the bridge 28. Accordingly, when the servomotor 38 is driven, the bridge 28 is vertically moved through the ball screw 32. As a result, the top ring shaft 18 and the top ring 1 are vertically moved. The polishing apparatus has a distance measuring sensor 70 serving as a position detecting device for detecting the distance from the distance measuring sensor 70 to a lower surface of the bridge 28, i.e. the position of the bridge 28. By detecting the position of the bridge 28 by the distance measuring sensor 70, the position of the top ring 1 can be detected. The distance measuring sensor 70 constitutes the vertically movable mechanism 24 together with the ball screw 32 and the servomotor 38. The distance measuring sensor 70 may comprise a laser sensor, an ultrasonic sensor, or an eddy current sensor, or a linear scale sensor. The polishing apparatus has a controller 47 for controlling various equipment including the distance measuring sensor 70 and the servomotor 38 in the polishing apparatus.

The polishing apparatus in the present embodiment has a dressing unit 40 for dressing the polishing surface 101*a* on the polishing table 100. The dressing unit 40 includes a dresser 50 which is brought into sliding contact with the polishing surface 101*a*, a dresser shaft 51 to which the dresser 50 is connected, an air cylinder 53 provided at an upper end of the dresser shaft 51, and a swing arm 55 rotatably supporting the dresser shaft 51. The dresser 50 has a dressing member 50*a* attached on a lower portion of the dresser 50. The dressing member 50*a* has diamond particles in the form of needles. These diamond particles are attached on a lower surface of the dressing member 50*a*. The air cylinder 53 is disposed on a support stage 57, which is supported by poles 56. The poles 56 are fixed to the swing arm 55.

The swing arm 55 is pivotable (swingable) about the support shaft 58 by actuation of a motor (not shown). The dresser shaft 51 is rotatable by actuation of a motor (not shown). Thus, the dresser 50 is rotated about the dresser shaft 51 by rotation of the dresser shaft 51. The air cylinder 53 vertically moves the dresser 50 via the dresser shaft 51 so as to press the dresser 50 against the polishing surface 101*a* of the polishing pad 101 under a predetermined pressing force.

Dressing operation of the polishing surface 101*a* on the polishing pad 101 is performed as follows. The dresser 50 is pressed against the polishing surface 101*a* by the air cylinder 53. Simultaneously, pure water is supplied onto the polishing surface 101*a* from a pure water supply nozzle (not shown). In this state, the dresser 50 is rotated about the dresser shaft 51, and the lower surface (diamond particles) of the dressing member 50*a* is brought into contact with the polishing surface 101*a*. Thus, the dresser 50 removes a portion of the polishing pad 101 so as to dress the polishing surface 101*a*.

The polishing apparatus in the present embodiment utilizes the dresser 50 to measure the amount of wear of the polishing pad 101. Specifically, the dressing unit 40 includes a displacement sensor 60 for measuring displacement of the dresser 50. The displacement sensor 60 constitutes a wear detecting device for detecting an amount of wear of the polishing pad 101, and is provided on an upper surface of the swing arm 55. A target plate 61 is fixed to the dresser shaft 51. The target plate 61 is vertically moved by vertical movement of the dresser 50. The displacement sensor 60 is inserted into a hole of the target plate 61. The displacement sensor 60 measures displacement of the target plate 61 to measure displacement of the dresser 50. The displacement sensor 60 may comprise any type of sensors including a linear scale sensor, a laser sensor, an ultrasonic sensor, and an eddy-current sensor.

In the present embodiment, the amount of wear of the polishing pad 101 is measured as follows. First, the air cylinder 53 is operated to bring the dresser 50 into contact with a polishing surface 101*a* of an unused polishing pad 101 which has been initially dressed. In this state, the displacement sensor 60 measures an initial position (initial height value) of the dresser 50 and stores the initial position (initial height value) in the storage device of the controller (arithmetical unit) 47. After completion of a polishing process for one or more semiconductor wafers, the dresser 50 is brought into contact with the polishing surface 101*a*. In this state, the position of the dresser 50 is measured. Since the position of the dresser 50 is shifted downward by the amount of wear of the polishing pad 101, the controller 47 calculates a difference between the initial position and the measured position of the dresser 50 after polishing to obtain the amount of wear of the polishing pad 101. In this manner, the amount of wear of the polishing pad 101 is calculated based on the position of the dresser 50.

When the semiconductor wafer is polished by the polishing apparatus shown in FIG. 1, the thickness of the polishing pad 101 varies at all times because the polishing pad 101 is progressively worn, dressed, and replaced. If the semiconductor wafer is pressed by an inflated elastic membrane in the top ring 1, then the range in which the outer peripheral area of the semiconductor wafer and the elastic membrane contact each other, and the surface pressure distribution over the outer peripheral area of the semiconductor wafer change depending on the distance between the elastic membrane and the semiconductor wafer. In order to prevent the surface pressure distribution over the semiconductor wafer from changing as the polishing process progresses, it is necessary to keep the distance between the top ring 1 and the polishing surface of the polishing pad 101 constant at the time of polishing. For keeping the distance between the top ring 1 and the polishing surface of the polishing pad 101 constant, it is necessary to detect the vertical position of the polishing surface of the polishing pad 101 and adjust the lowered position of the top ring 1 after the polishing pad 101 is replaced and initially dressed by the dresser 50 as described later, for example. The process of detecting the vertical position of the polishing surface of the polishing pad 101 will be referred to as "pad search" by the top ring.

The pad search by the top ring is carried out by detecting the vertical position (height) of the top ring 1 when the lower surface of the top ring 1 or the lower surface of the semiconductor wafer is brought into contact with the polishing surface of the polishing pad 101. Specifically, in the pad search by the top ring, the top ring 1 is lowered by the servomotor 38 while the number of revolutions of the servomotor 38 is being counted by an encoder combined with the servomotor 38. When the lower surface of the top ring 1 contacts the polishing surface of the polishing pad 101, the load on the servomotor 38 increases, and the current flowing through the servomotor 38 increases. The current flowing through the servomotor 38 is detected by a current detector in the controller 47. When the detected current becomes large, the controller 47 judges that the lower surface of the top ring 1 contacts the polishing surface of the polishing pad 101. At the same time, the controller 47 calculates the lowered distance (position) of the top ring 1 from the count (integration value) of the encoder, and stores the calculated lowered distance. The controller 47 then obtains the vertical position (height) of the polishing surface of the polishing pad 101 from the lowered distance of the top ring 1, and calculates a preset polishing position of the top ring 1 from the vertical position of the polishing surface of the polishing pad 101.

The semiconductor wafer used in the pad search by the top ring should preferably be a dummy wafer for use in the pad search, rather than a product wafer. Although a product wafer may be used in the pad search, semiconductor devices on such product wafer may possibly be broken in the pad search. Using a dummy wafer in the pad search is effective to prevent semiconductor devices on such product wafer from being damaged or broken.

The servomotor 38 should preferably be a servomotor with a variable maximum current. In the pad search, the maximum current of the servomotor 38 may be adjusted to a value ranging from about 25% to 30% to prevent the semiconductor wafer (dummy wafer), the top ring 1, and the polishing pad 101 from being placed under an excessive load when the lower surface of the top ring 1 or the lower surface of the semiconductor wafer (dummy wafer) is brought into contact with the polishing surface of the polishing pad 101. Since the time when the top ring 1 will contact the polishing pad 101 can approximately be predicted from the descending time or the descending distance of the top ring 1, the maximum current of the servomotor 38 should preferably be lowered before the top ring 1 contacts the polishing pad 101. In this manner, the top ring 1 can be lowered quickly and reliably.

Figure 2:
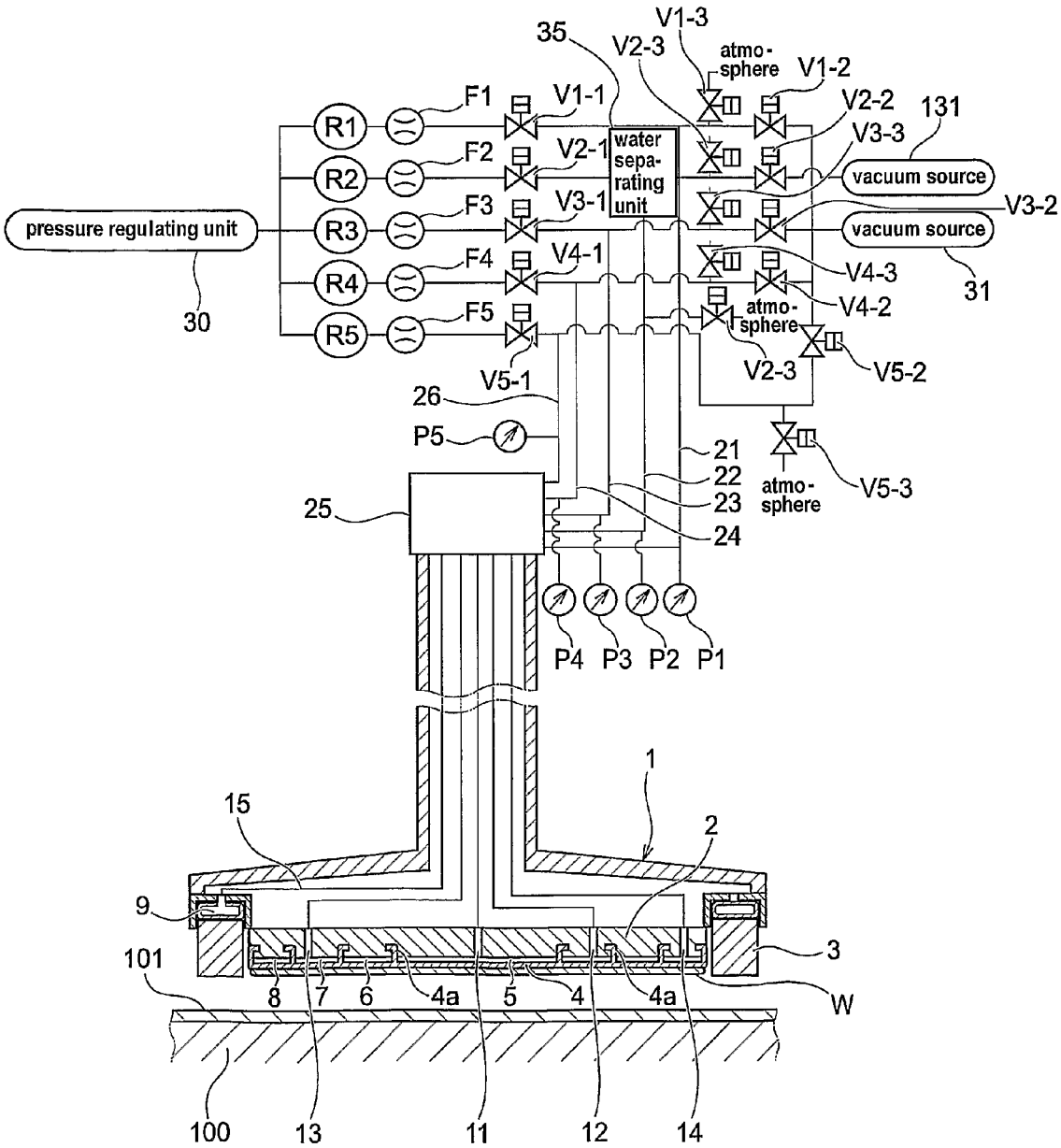
FIG. 2 is a schematic cross-sectional view showing a top ring constituting a polishing head for holding a semiconductor wafer as an object to be polished and pressing the semiconductor wafer against a polishing surface on a polishing table.

Next, a polishing head (top ring) of the polishing apparatus according to the present invention will be described below with reference to FIG. 2. FIG. 2 is a schematic cross-sectional view showing the top ring 1 constituting a polishing head for holding a semiconductor wafer as an object to be polished and pressing the semiconductor wafer against the polishing surface on the polishing table. FIG. 2 shows only main structural elements constituting the top ring 1.

As shown in FIG. 2, the top ring 1 basically comprises a top ring body 2, also referred to as carrier, for pressing a semiconductor wafer W against the polishing surface 101*a*, and a retainer ring 3 for directly pressing the polishing surface 101*a*. The top ring body (carrier) is in the form of a circular plate, and the retainer ring 3 is attached to a peripheral portion of the top ring body 2. The top ring body 2 is made of resin such as engineering plastics (e.g. PEEK). As shown in FIG. 2, the top ring 1 has an elastic membrane (membrane) 4 attached to a lower surface of the top ring body 2. The elastic membrane 4 is brought into contact with a rear face of a semiconductor wafer held by the top ring 1. The elastic membrane 4 is made of a highly strong and durable rubber material such as ethylene propylene rubber, (EPDM), polyurethane rubber, silicone rubber, or the like.

The elastic membrane (membrane) 4 has a plurality of concentric partition walls 4*a*, and a circular central chamber 5, an annular ripple chamber 6, an annular outer chamber 7 and an annular edge chamber 8 are defined by the partition walls 4*a* between the upper surface of the elastic membrane 4 and the lower surface of the top ring body 2. Specifically, the central chamber 5 is defined at the central portion of the top ring body 2, and the ripple chamber 6, the outer chamber 7 and the edge chamber 8 are concentrically defined in the order from the central portion to the peripheral portion of the top ring body 2. A passage 11 communicating with the central chamber 5, a passage 12 communicating with the ripple chamber 6, a passage 13 communicating with the outer chamber 7 and a passage 14 communicating with the edge chamber 8 are formed in the top ring body 2. The passage 11 communicating with the center chamber 5, the passage 13 communicating with the outer chamber 7 and the passage 14 communicating with the edge chamber 8 are connected via a rotary joint 25 to passages 21, 23 and 24, respectively. The respective passages 21, 23 and 24 are connected via respective valves V1-1, V3-1, V4-1 and respective pressure regulators R1, R3, R4 to a pressure regulating unit 30. Further, the respective passages 21, 23 and 24 are connected via respective valves V1-2, V3-2, V4-2 to a vacuum source 31, and are also connected via respective valves V1-3, V3-3, V4-3 to the atmosphere.

On the other hand, the passage 12 communicating with the ripple chamber 6 is connected via the rotary joint 25 to the passage 22. The passage 22 is connected via a water separating tank 35, a valve V2-1 and the pressure regulator R2 to the pressure regulating unit 30. Further, the passage 22 is connected via the water separating tank 35 and the valve V2-2 to a vacuum source 131, and is also connected via a valve V2-3 to the atmosphere.

Further, a retainer ring chamber 9 is formed immediately above the retainer ring 3, and the retainer ring chamber 9 is connected via a passage 15 formed in the top ring body (carrier) 2 and the rotary joint 25 to a passage 26. The passage 26 is connected via a valve V5-1 and a pressure regulator R5 to the pressure regulating unit 30. Further, the passage 26 is connected via a valve V5-2 to the vacuum source 31, and is also connected via a valve V5-3 to the atmosphere. The pressure regulators R1, R2, R3, R4 and R5 have a pressure adjusting function for adjusting pressures of the pressurized fluid supplied from the pressure regulating unit 30 to the central chamber 5, the ripple chamber 6, the outer chamber 7, the edge chamber 8 and the retainer ring chamber 9, respectively. The pressure regulators R1, R2, R3, R4 and R5 and the respective valves V1-1-V1-3, V2-1-V2-3, V3-1-V3-3, V4-1-V4-3 and V5-1-V5-3 are connected to the controller 47 (see FIG. 1), and operations of these pressure regulators and these valves are controlled by the controller 47. Further, pressure sensors P1, P2, P3, P4 and P5 and flow rate sensors F1, F2, F3, F4 and F5 are provided in the passages 21, 22, 23, 24 and 26, respectively.

In the top ring 1 constructed as shown in FIG. 2, as described above, the central chamber 5 is defined at the central portion of the top ring body 2, and the ripple chamber 6, the outer chamber 7 and the edge chamber 8 are concentrically defined in the order from the central portion to the peripheral portion of the top ring body 2. The pressures of the fluid supplied to the central chamber 5, the ripple chamber 6, the outer chamber 7, the edge chamber 8 and the retainer ring chamber 9 can be independently controlled by the pressure regulating unit 30 and the pressure regulators R1, R2, R3, R4 and R5. With this arrangement, pressing forces for pressing the semiconductor wafer W against the polishing pad 101 can be adjusted at respective local areas of the semiconductor wafer by adjusting pressures of the fluid to be supplied to the respective pressure chambers, and a pressing force for pressing the retainer ring 3 against the polishing pad 101 can be adjusted by adjusting a pressure of the fluid to be supplied to the pressure chamber.

Figure 3:
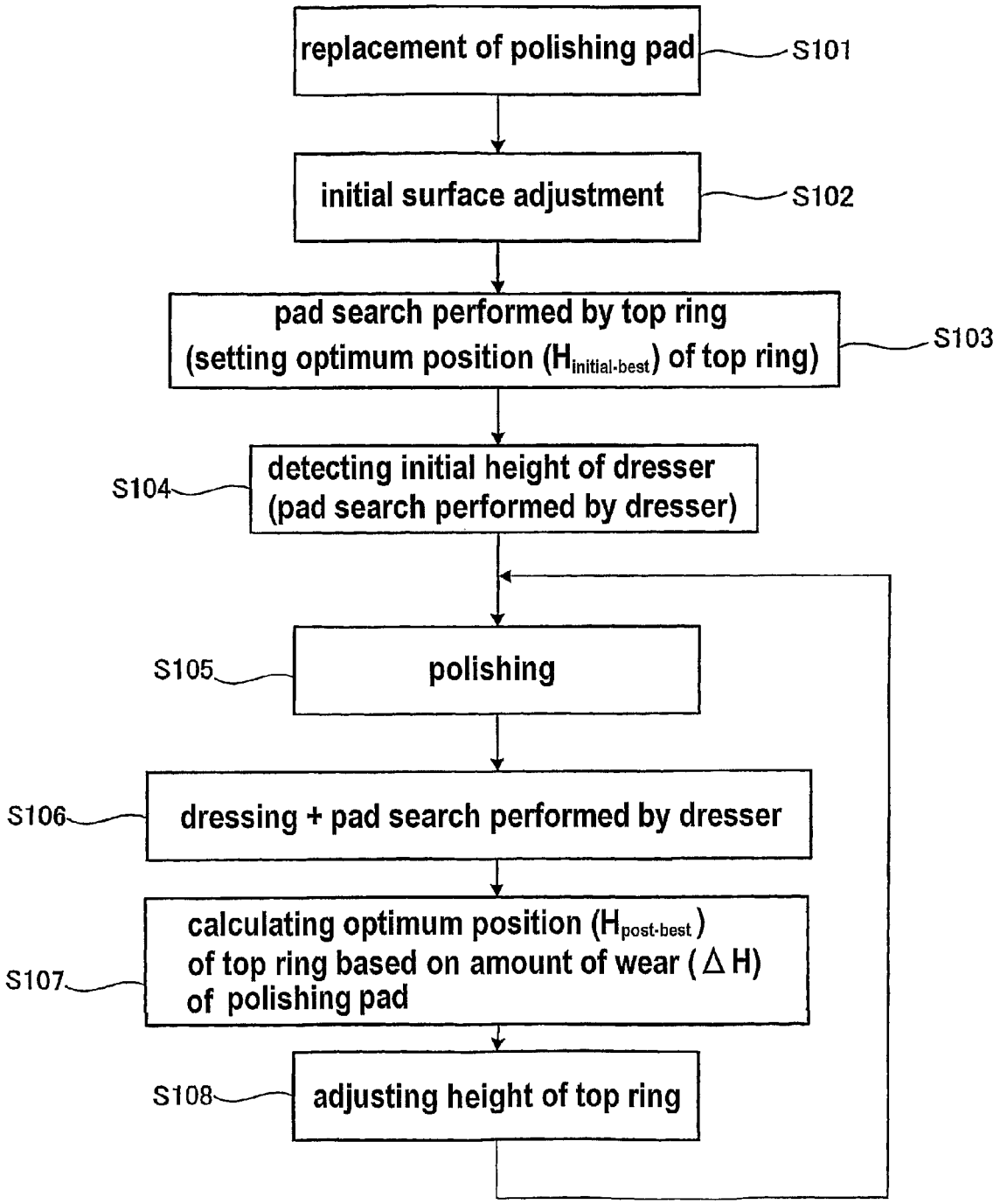
FIG. 3 is a flowchart of a series of polishing processes of the polishing apparatus according to the present embodiment.

A series of polishing processes of the polishing apparatus shown in FIGS. 1 and 2 will be described below with reference to FIG. 3. FIG. 3 is a flowchart of the series of polishing processes of the polishing apparatus according to the present embodiment. As shown in FIG. 3, the polishing processes start with the replacement of the polishing pad in step S101. Specifically, the polishing pad which has been worn is detached from the polishing table 100, and a brand-new polishing pad 101 is mounted on the polishing pad 100.

The brand-new polishing pad 101 has a low polishing capability because its polishing surface is not rough and has surface undulations due to the way in which the polishing pad 101 is mounted on the polishing table 100 or due to the individual configuration of the polishing pad 101. In order to correct such surface undulations to prepare the polishing pad 101 for polishing, it is necessary to dress the polishing pad 101 to roughen the polishing surface thereof for an increased polishing capability. The initial surface adjustment (dressing) is referred to as initial dressing (step S102).

Then, the pad search is performed by the top ring 1 using a dummy wafer for pad search in step S103. As described above, the pad search is a process for detecting the vertical height (position) of the surface of the polishing pad 101. The pad search is performed by detecting the vertical height of the top ring 1 when the lower surface of the top ring 1 is brought into contact with the polishing surface of the polishing pad 101.

Specifically, in the pad search, the servomotor 38 is energized to lower the top ring 1 while the number of revolutions of the servomotor 38 is being counted by the encoder combined with the servomotor 38. When the lower surface of the top ring 1 contacts the polishing surface of the polishing pad 101, the load on the servomotor 38 increases, and the current flowing through the servomotor 38 increases. The current flowing through the servomotor 38 is detected by the current detector in the controller 47. When the detected current becomes large, the controller 47 judges that the lower surface of the top ring 1 contacts the polishing surface of the polishing pad 101. At the same time, the controller 47 calculates the lowered distance (position) of the top ring 1 from the count (integration value) of the encoder, and stores the calculated lowered distance. The controller 47 then obtains the vertical height of the polishing surface of the polishing pad 101 from the lowered distance of the top ring 1, and calculates the optimum position of the top ring 1 before polishing from the vertical height of the polishing surface of the polishing pad 101.

In the present embodiment, when the top ring 1 is in an optimum position before polishing, the lower surface, i.e. the surface to be polished, of the semiconductor wafer W which is held as a product wafer by the top ring 1 is spaced from the polishing surface of the polishing pad 101 by a slight gap.

The vertical position of the top ring in which the lower surface, i.e. the surface to be polished, of the semiconductor wafer W held as a product wafer by the top ring 1 is not brought into contact with the polishing surface of the polishing pad 101, but is spaced by the slight gap from the polishing surface of the polishing pad 101, is set as an optimum position ($H_{initial\text{-}best}$) of the top ring 1 in the controller 47 (step S103).

Then, a pad search by the dresser 50 is performed in step S104. The pad search by the dresser 50 is carried out by detecting the vertical height of the dresser 50 when the lower surface of the dresser 50 is brought into contact with the polishing surface of the polishing pad 101 under a predetermined pressure. Specifically, the air cylinder 53 is actuated to bring the dresser 50 into contact with the polishing surface 101*a* of the polishing pad 101 which has been initially dressed. The displacement sensor 60 detects the initial position (initial height) of the dresser 50, and the controller (processor) 47 stores the detected initial position (initial height) of the dresser 50. The initial dressing process in step S102 and the pad search by the dresser in step S104 may be carried out simultaneously. Specifically, the vertical position (initial position) of the dresser 50 may be detected finally in the initial dressing process, and the detected vertical position (initial height value) of the dresser 50 may be stored in the controller (processor) 47.

If the initial dressing process in step S102 and the pad search by the dresser in step S104 are carried out simultaneously, then they are followed by the pad search by the top ring in step S103.

Then, the top ring 1 receives and holds a semiconductor wafer as a product wafer from a substrate transfer apparatus (pusher). Thereafter, the top ring 1 is lowered to the preset position ($H_{initial\text{-}best}$) which has been obtained in the pad search by the top ring in step S103. Before the semiconductor wafer is polished, since the semiconductor wafer is attached to and held by the top ring 1, there is a small gap between the lower surface (the surface to be polished) of the semiconductor wafer and the polishing surface of the polishing pad 101. At this time, the polishing table 100 and the top ring 1 are being rotated about their own axes. Then, the elastic membrane (membrane) located at the upper surface of the semiconductor wafer is inflated under the pressure of a fluid supplied thereto to press the lower surface (surface to be polished) of the semiconductor wafer against the polishing surface of the polishing pad 101. As the polishing table 100 and the top ring 1 are being moved relative to each other, the lower surface of the semiconductor wafer is polished to a predetermined state, e.g. a predetermined film thickness, in step S105.

When the polishing of the lower surface of the semiconductor wafer is finished in step S105, the top ring 1 transfers the polished semiconductor wafer to the substrate transfer apparatus (pusher), and receives a new semiconductor wafer to be polished from the substrate transfer apparatus. While the top ring 1 is replacing the polished semiconductor wafer with the new semiconductor wafer, the dresser 50 dresses the polishing pad 101 in step S106.

The polishing surface 101*a* of the polishing pad 101 is dressed as follows: The air cylinder 53 presses the dresser 50 against the polishing surface 101*a*, and at the same time a pure water supply nozzle (not shown) supplies pure water to the polishing surface 101*a*. In this state, the dresser 50 rotates around the dresser shaft 51 to bring the lower surface (diamond particles) of the dressing member 50*a* into sliding contact with the polishing surface 101*a*. The dresser 50 scrapes off a surface layer of the polishing pad 101, and the polishing surface 101*a* is dressed.

After the polishing surface 101*a* is dressed, the pad search by the dresser 50 is performed in step S106. The pad search by the dresser 50 is carried out in the same manner as with step S104. Although the pad search by the dresser may be performed after the dressing process separately from the dressing process, alternatively, the pad search by the dresser 50 may be performed finally in the dressing process, so that the pad search by the dresser 50 and the dressing process can be carried out simultaneously. In step S106, the dresser 50 and the polishing table 100 should be rotated at the same speeds, and the dresser 50 may be loaded under the same conditions, as with step S104. According to the pad search by the dresser 50, the vertical position of the dresser 50 after dressing is detected in step S106.

Then, the controller 47 determines the difference between the initial position (initial height value) of the dresser 50 determined in step S104 and the vertical position of the dresser 50 determined in step S106, thereby determining an amount of wear (ΔH) of the polishing pad 101.

The controller 47 then calculates an optimum position ($H_{post\text{-}best}$) of the top ring 1 for polishing a next semiconductor wafer according to the following equation (1) based on the amount of wear (ΔH) of the polishing pad 101 and the preset position ($H_{initial\text{-}best}$) of the top ring 1 at the time of polishing, which has been determined in the pad search in step S103, in step S107:

$$H_{post\text{-}best}=H_{initial\text{-}best}+\Delta H \quad (1)$$

Specifically, the amount of wear (ΔH) of the polishing pad 101, which is a factor that affects the vertical position of the top ring 1 during the polishing process, is detected, and the preset position ($H_{initial\text{-}best}$) of the top ring 1 which has been set is corrected based on the amount of wear (ΔH) of the polishing pad 101 which has been detected, thereby determining a preset position ($H_{post\text{-}best}$) of the top ring 1 for polishing a next semiconductor wafer. In this manner, the top ring 1 is controlled so as to take an optimum vertical position at all times in the polishing process.

Next, the servomotor 38 is energized to lower the top ring 1 which holds the semiconductor wafer W to the preset position ($H_{post\text{-}best}$) of the top ring 1 determined in step S107, thereby adjusting the height of the top ring 1 in step S108. Thereafter, steps S105 through S108 are repeated until the polishing pad 101 is worn out to polish a number of semiconductor wafers. Thereafter, the polishing pad 101 is replaced in step S101.

As described above with reference to the flowchart shown in FIG. 3, while the polishing apparatus is in operation, the amount of wear (ΔH) of the polishing pad 101, which is a factor that affects the vertical position of the top ring 1 at the time of polishing, is detected, and the preset position ($H_{initial\text{-}best}$) of the top ring 1 which has been set is corrected based on the amount of wear (ΔH) of the polishing pad 101 which has been detected, thereby determining a preset position ($H_{post\text{-}best}$) of the top ring 1 for polishing a next semiconductor wafer W. In this manner, the top ring 1 is controlled so as to take an optimum vertical position at all times in the polishing process. Therefore, the pad search by the top ring for directly obtaining the preset position of the top ring 1 at the time of polishing should be performed only when the polishing pad is replaced, resulting in a greatly increased throughput.

Next, an optimum height of the elastic membrane (membrane) when application of the pressure to the semiconductor wafer is started or the semiconductor wafer is vacuum-chucked to the top ring in the polishing apparatus constructed as shown in FIGS. 1 and 2 will be described with reference to FIGS. 4 through 24.

Figures 4A, 4B, 4C:
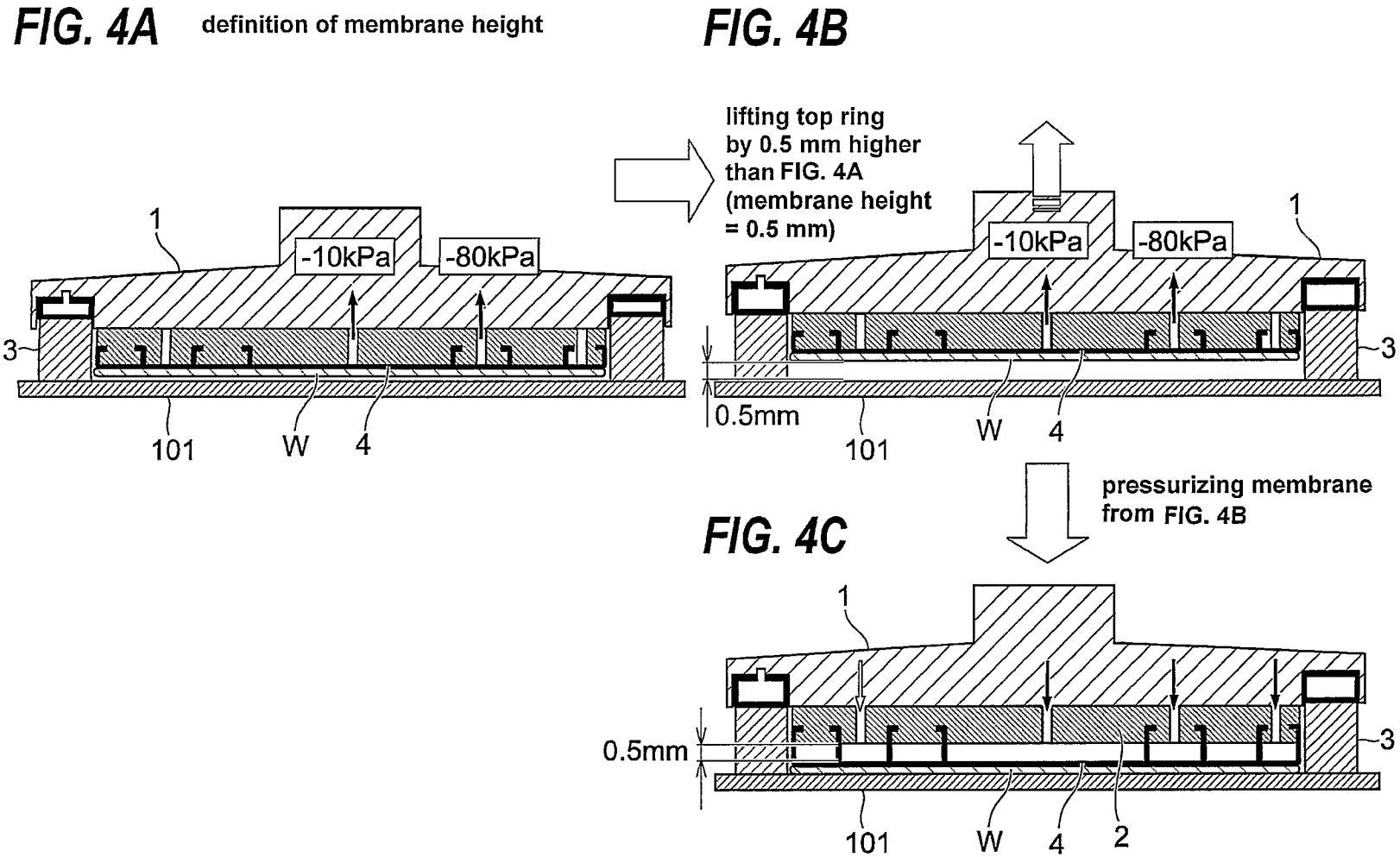
FIGS. 4A, 4B and 4C are schematic views showing a membrane height.

FIGS. 4A through 4C are schematic views for explaining a membrane height. FIG. 4A is a schematic view showing the state in which a membrane height, which is defined as a clearance between the semiconductor wafer W and the polishing pad 101 under the condition that the semiconductor wafer W is vacuum-chucked to the membrane 4, is equal to 0 mm, i.e. "membrane height=0 mm" The "membrane height=0 mm" (contact position between the semiconductor wafer and the polishing pad 101) can be detected by the above-mentioned pad search. As shown in FIG. 4A, the top ring height in which the semiconductor wafer W is brought into contact with the polishing pad 101 under the condition that the semiconductor wafer is vacuum-chucked to the top ring is taken as "membrane height=0 mm." Then, the position of the top ring in which the top ring is moved upwardly by X mm from the position shown in FIG. 4A (membrane height=0 mm) is taken as "membrane height=X mm." For example, the membrane height=1 mm (clearance 1 mm) is obtained by rotating the top ring shaft motor by certain pulses corresponding to 1 mm to rotate the ball screw, thereby displacing 1 mm.

The pad surface can be detected by the pad search with an accuracy of about ±0.01 mm. Further, an error of the top ring height is regarded as the total error of a control error of the top ring shaft motor plus a control error of the ball screw, and is negligibly small. The error of the membrane height is about ±0.01 mm.

FIG. 4B is a schematic view showing the state of "membrane height=0.5 mm." As shown in FIG. 4B, the semiconductor wafer W is vacuum-chucked to the top ring, and the top ring 1 is lifted by 0.5 mm from the position shown in FIG. 4A. This lifted state of the top ring 1 is taken as "membrane height=0.5 mm."

FIG. 4C is a schematic view showing the membrane height which is defined as a clearance between the top ring body (carrier) 2 and the membrane 4 under the condition that the semiconductor wafer is pressed against the polishing pad 101 by the membrane 4. As shown in FIG. 4C, the membrane 4 is lowered to press the semiconductor wafer W against the polishing pad 101 by supplying a pressurized fluid to the pressure chambers. In this state, the membrane height is defined as a clearance between the lower surface of the carrier and the upper surface of the membrane. In FIG. 4C, the clearance between the lower surface of the carrier and the upper surface of the membrane is 0.5 mm, and thus it follows that "membrane height=0.5 mm." In FIGS. 4A through 4C, the retainer ring 3 is brought into contact with the polishing surface 101*a* of the polishing pad 101.

Next, an optimum membrane height in various operations performed in the polishing process will be described below.

(1) At the Time of Starting Application of the Pressure

Figure 5:
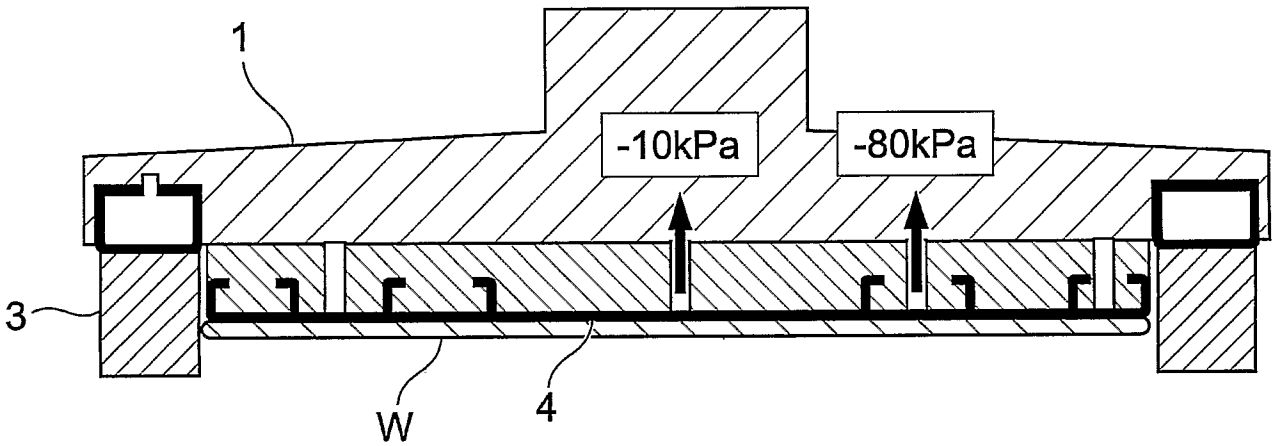
FIG. 5 is a schematic view showing the state of the top ring which vacuum-chucks the semiconductor wafer before the top ring is lowered.

FIG. 5 is a schematic view showing the state of the top ring 1 which vacuum-chucks the semiconductor wafer W before the top ring 1 is lowered. As shown in FIG. 5, the semiconductor wafer W is vacuum-chucked to the top ring 1. The polishing table 100 and the top ring 1 are rotated in a state in which the top ring 1 vacuum-chucks the semiconductor wafer W, and the top ring 1 is lowered onto the polishing pad 101.

Figure 6:
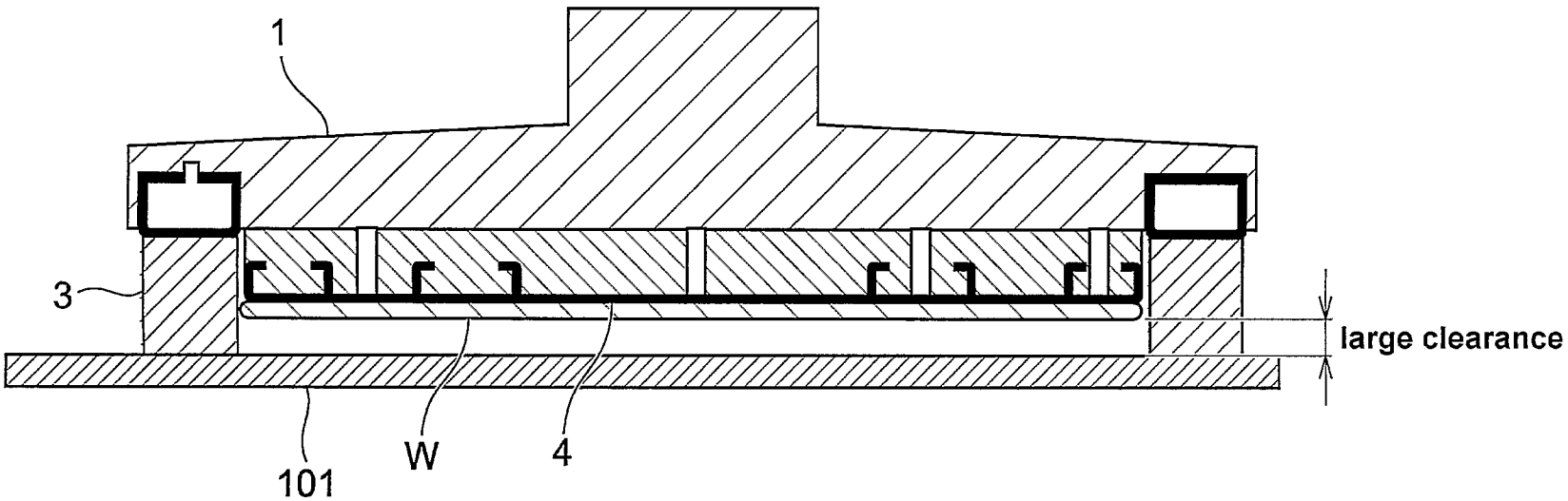
FIG. 6 is a schematic view showing the state of the top ring which vacuum-chucks the semiconductor wafer and is lowered, with a large clearance between the semiconductor wafer and the polishing pad left.

FIG. 6 is a schematic view showing the state of the top ring 1 which vacuum-chucks the semiconductor wafer W and is lowered, with a large clearance between the semiconductor wafer W and the polishing pad 101 left. FIG. 7A is a schematic view showing deformation state of the semiconductor wafer in the case where application of the pressure is started from the state of a large clearance between the semiconductor wafer and the polishing pad as shown in FIG. 6. FIG. 7B is a graph showing deformation quantity of the semiconductor wafer in the case where application of the pressure is started from the state of a large clearance between the semiconductor wafer and the polishing pad. In FIG. 7B, the horizontal axis represents measuring points (mm) within the wafer plane in 300 mm Wafer, and the vertical axis represents distances from the polishing pad to the semiconductor wafer obtained every time one revolution of the polishing table is performed when the eddy current sensor provided on the polishing table scans the lower surface (surface to be polished) of the semiconductor wafer by rotation of the polishing table.

In the example shown in FIG. 7A, because pressurization of the ripple area (the ripple chamber 6) is delayed in comparison with pressurization in other areas (the central chamber 5, the outer chamber 7 and the edge chamber 8), the semiconductor wafer W is deformed into substantially M-shape. As shown in FIG. 7A, deformation allowance of the wafer corresponding to the clearance before starting pressurization exists, and thus the wafer is deformed to a large degree. The reason why pressurization of the ripple area is delayed is that the membrane has holes for vacuum-chucking the wafer in the ripple area, and the ripple area serves as an area for vacuum-chucking the wafer, and thus the water separating tank 35 (see FIG. 2) having a large volume is provided in the middle of the line to cause inferior response of pressurization in comparison with other areas.

From experimental data of FIG. 7B, the manner in which the wafer is deformed into substantially M-shape in the process of pressing the wafer W against the polishing pad 101 after starting pressurization can be traced. As shown in FIG. 7B, the wafer is deformed by about 0.7 mm within the wafer plane. Therefore, in order to reduce this influence, a buffer equivalent to the water separating tank 35 in volume is provided in the line other than the ripple area line so that the respective lines are equivalent in volume to adjust the responsiveness of pressurization at the same level. Further, pressurization may be made in the order from the large volume area to the small volume area. For example, after the ripple chamber 6 is pressurized, the central chamber 5, the outer chamber 7 and the edge chamber 8 are pressurized in the order from the central portion to the outer peripheral portion of the top ring 1.

Further, as a means for adjusting the responsiveness, set pressures in the respective pressure chambers may be changed. For example, by pressurizing the ripple chamber 6 having a large volume at a set pressure higher than set pressures of other chambers, i.e. the central chamber 5, the outer chamber 7 and the edge chamber 8, build-up responsiveness of pressure of the ripple chamber 6 may be improved. Further, as a means for improving the pressure responsiveness of the ripple chamber 6, as shown in FIG. 7C, a passage 22 communicating with the ripple chamber 6 may be provided. In the top ring 1 thus constructed, when the ripple chamber 6 is pressurized, the pressure regulator R2 is operated, and the valve V2-1 is opened and the shut valve V2-4 is closed, so that the pressurized fluid may be supplied to the ripple chamber 6 without passing through the water separating tank 35 to obtain quick pressure response.

Figure 8:
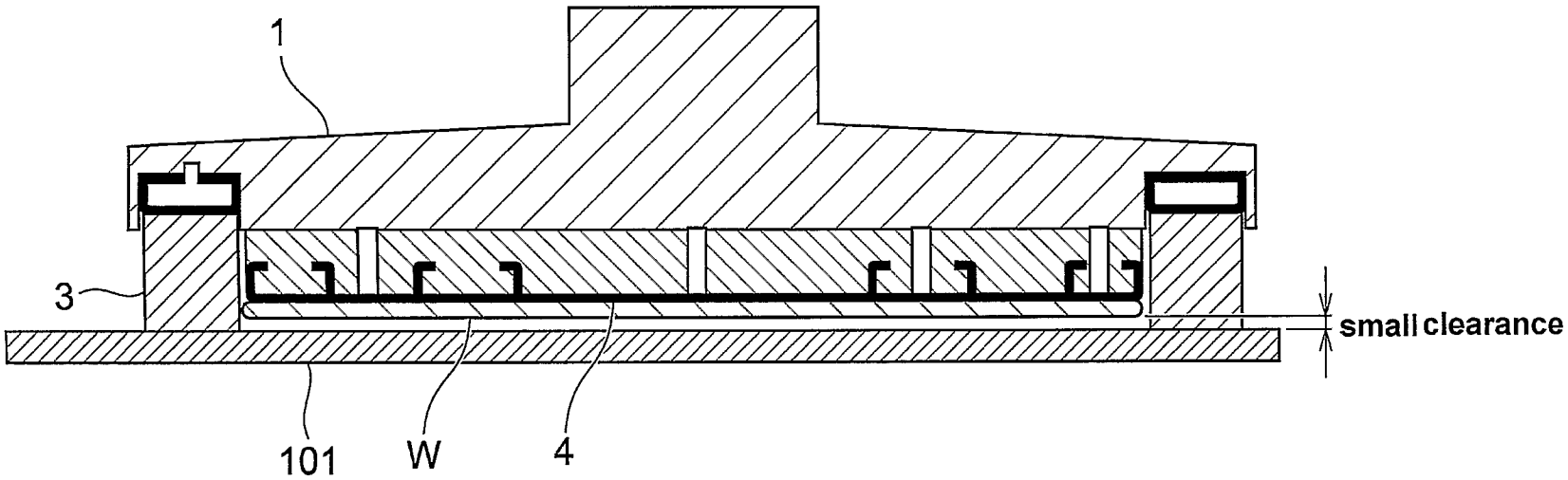
FIG. 8 is a view showing a first aspect of the present invention, and is a schematic view showing the case in which the top ring holding the wafer under vacuum is lowered and there is a small clearance between the wafer and the polishing pad.

FIG. 8 is a view showing a first aspect of the present invention, and is a schematic view showing the case in which the top ring 1 holding the wafer W under vacuum is lowered and there is a small clearance between the wafer W and the polishing pad 101. In the first aspect of the present invention, the top ring 1 holding the wafer W under vacuum is lowered, and the retainer ring 3 is brought into contact with the polishing surface 101*a* of the polishing pad 101. In this state, the membrane height, i.e. the clearance between the wafer W and the polishing pad 101 is arranged in the range of 0.1 mm to 1.7 mm. Specifically, the vertical distance (height) of the top ring 1 from the polishing pad is defined as "the first height" in a state in which the top ring 1 holding the wafer W under vacuum is lowered and the retainer ring 3 is brought into contact with the polishing surface 101*a* of the polishing pad 101.

As described above, the membrane height is as follows: The top ring height in which the wafer W is vacuum-chucked to the top ring and is brought into contact with the polishing pad 101 is taken as "membrane height=0 mm." For example, in the state of "membrane height=0.5 mm", the clearance between the wafer W vacuum-chucked to the top ring and the polishing pad 101 becomes 0.5 mm.

When the wafer W is pressed against the polishing pad 101, the lower surface of the wafer is brought in contact with the polishing pad, and the upper surface of the wafer is brought in contact with the lower surface of the membrane. Therefore, if the membrane height is made high, the clearance between the lower surface of the top ring body (carrier) and the upper surface of the membrane increases. If the clearance between the wafer W and the polishing pad 101 is too small, the wafer may be brought into contact with the polishing pad locally, and excessive polishing may occur at local regions of the wafer. Therefore, according to the present invention, the clearance between the wafer W and the polishing pad 101 is arranged in the range of 0.1 mm to 1.7 mm, preferably 0.1 mm to 0.7 mm, more preferably 0.2 mm. Specifically, the reason why the clearance is not less than 0.1 mm is that undulation of the polishing table 100 in its vertical direction occurs during rotation of the polishing table 100 and there is variation in perpendicularity between the polishing table 100 and the top ring shaft 18, the clearance no longer exists in local areas within the wafer plane, and thus the carrier may be brought into contact with the membrane and excessive pressurization may occur in certain areas of the wafer. Further, the reason why the clearance is not more than 0.7 mm is that the deformation quantity of the wafer at the time of starting pressurization does not become too large. In order to prevent the wafer W from colliding with the retainer rig 3 strongly at the time of starting pressurization, it is desirable that when pressurization is started, the polishing table 100 and the top ring 1 should be rotated at a low rotational speed of 50 rpm or less. Alternatively, pressurization may be started in a state in which rotation of the polishing table 100 and the top ring 1 is stopped.

Figure 9A:
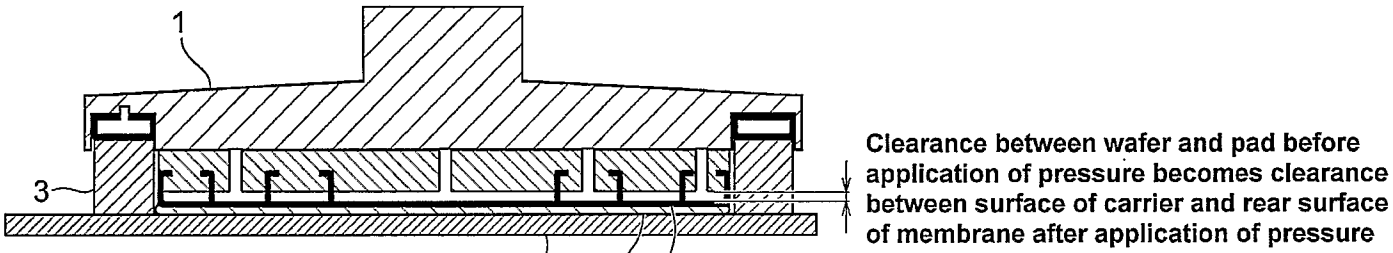
FIG. 9A is a schematic cross-sectional view showing the state in which application of the pressure to the membrane is started from the state of a small clearance between the wafer and the polishing pad.

FIG. 9A is a schematic cross-sectional view showing the state in which application of the pressure to the membrane is started from the state of a small clearance between the wafer and the polishing pad (clearance of 0.1 mm to 0.7 mm).

Figure 9B:
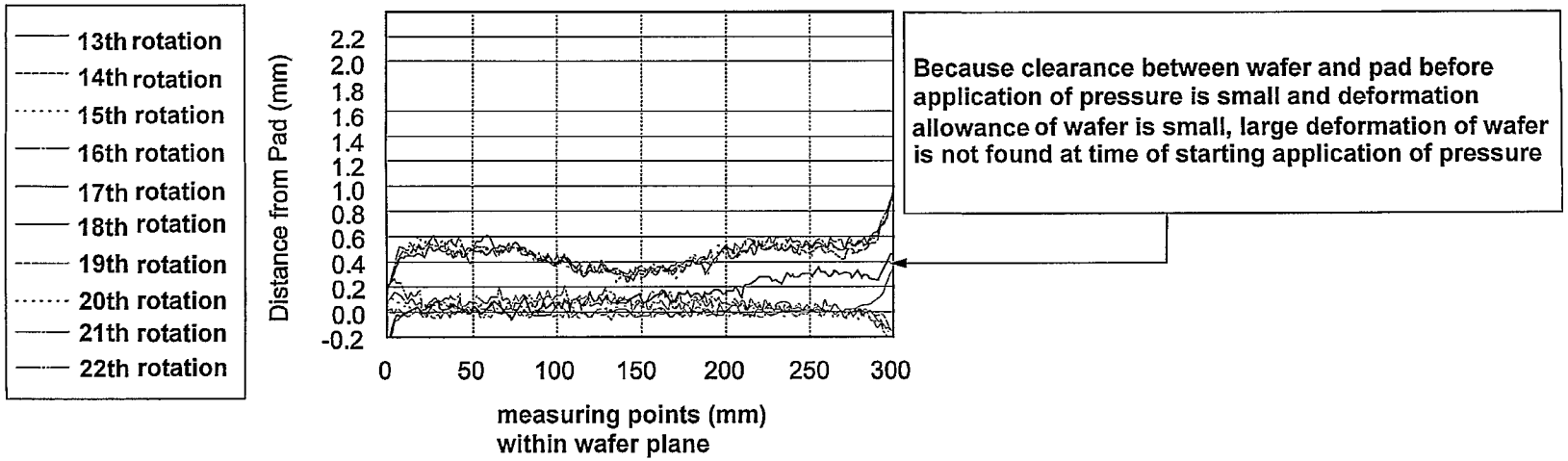
FIG. 9B is a graph showing deformation quantity of the wafer in the case where application of the pressure is started from the state of a small clearance between the wafer and the polishing pad.

FIG. 9B is a graph showing deformation quantity of the wafer in the case where application of the pressure is started from the state of a small clearance between the wafer and the polishing pad. In FIG. 9B, the horizontal axis represents measuring points (mm) within the wafer plane in 300 mm Wafer, and the vertical axis represents distances from the polishing pad to the wafer obtained every time one revolution of the polishing table is performed when the eddy current sensor provided on the polishing table scans the lower surface (surface to be polished) of the wafer by rotation of the polishing table. For example, the pressure is applied to the membrane from the state of "membrane height=0.2 mm", and the wafer W is brought into contact with the polishing pad 101 and is pressed against the polishing pad 101. At this time, the membrane is expanded by an amount corresponding to the clearance between the wafer and the polishing pad, and thus the clearance between the wafer and the polishing pad no longer exists. Instead, the clearance between the lower surface of the carrier and the upper surface of the membrane becomes 0.2 mm. Thereafter, the top ring is moved to an optimum height in order to obtain a desired polishing profile.

From experimental data of FIG. 9B, the manner in which the wafer is not deformed in the process of pressing the wafer W against the polishing pad 101 after starting pressurization can be traced.

Figure 10:
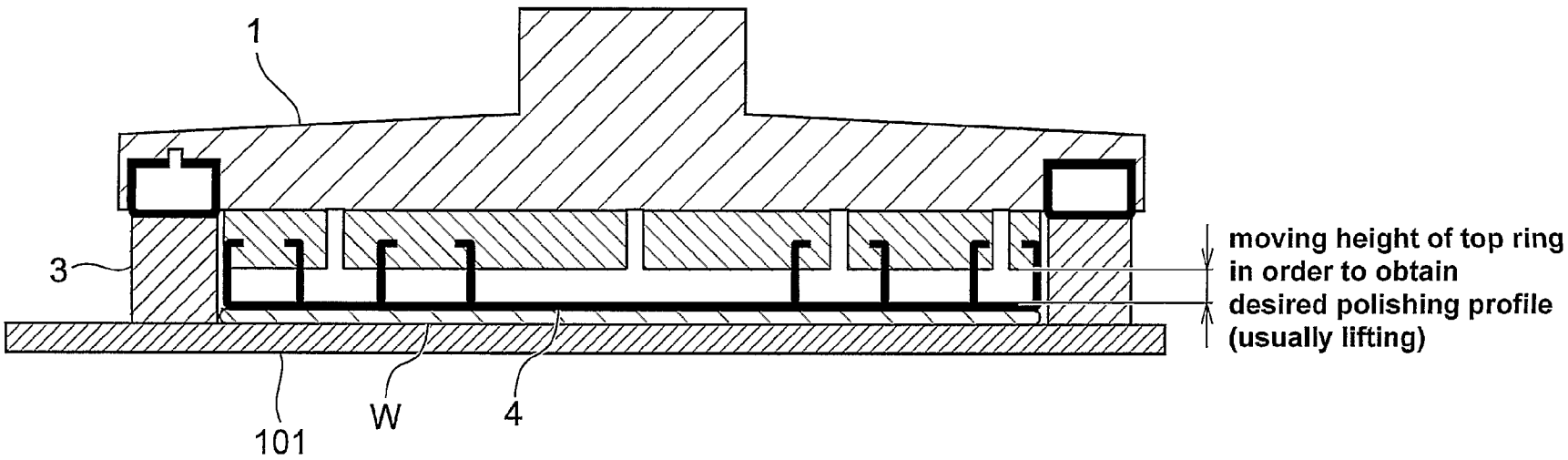
FIG. 10 is a schematic view showing the state in which the top ring is moved from the state shown in FIG. 9A to an optimum height in order to obtain desired polishing profile.

FIG. 10 is a schematic view showing the state in which the top ring 1 is moved from the state shown in FIG. 9A to an optimum height in order to obtain a desired polishing profile. FIG. 10 shows the membrane height defined as a clearance between the top ring body (carrier) 2 and the membrane 4 in a state in which the wafer W is pressed against the polishing pad 101 by the membrane 4. In this case, if stock removal of the edge portion of the wafer should be increased, the wafer should be polished at a low membrane height, and if stock removal of the edge portion of the wafer should be decreased, the wafer should be polished at a high membrane height. This is because if the membrane height is high, an elongation of the membrane in a vertical direction increases to increase pressure loss due to tension of the membrane, thus decreasing the pressure applied to the edge portion of the wafer. According to the present invention, after the wafer W is pressed against the polishing pad 101, the top ring is moved so that the membrane height becomes in the range of 0.1 mm to 2.7 mm, preferably 0.1 mm to 1.2 mm, and then the wafer W is polished. Specifically, the vertical distance from the polishing pad to the top ring when the top ring 1 is moved to obtain more desired polishing profile from "the first height" in a state in which the top ring 1 holding the wafer W under vacuum is lowered and the retainer wing 3 is brought in contact with the polishing surface 101*a* of the polishing pad 101 is defined as "the second height."

Figure 11:
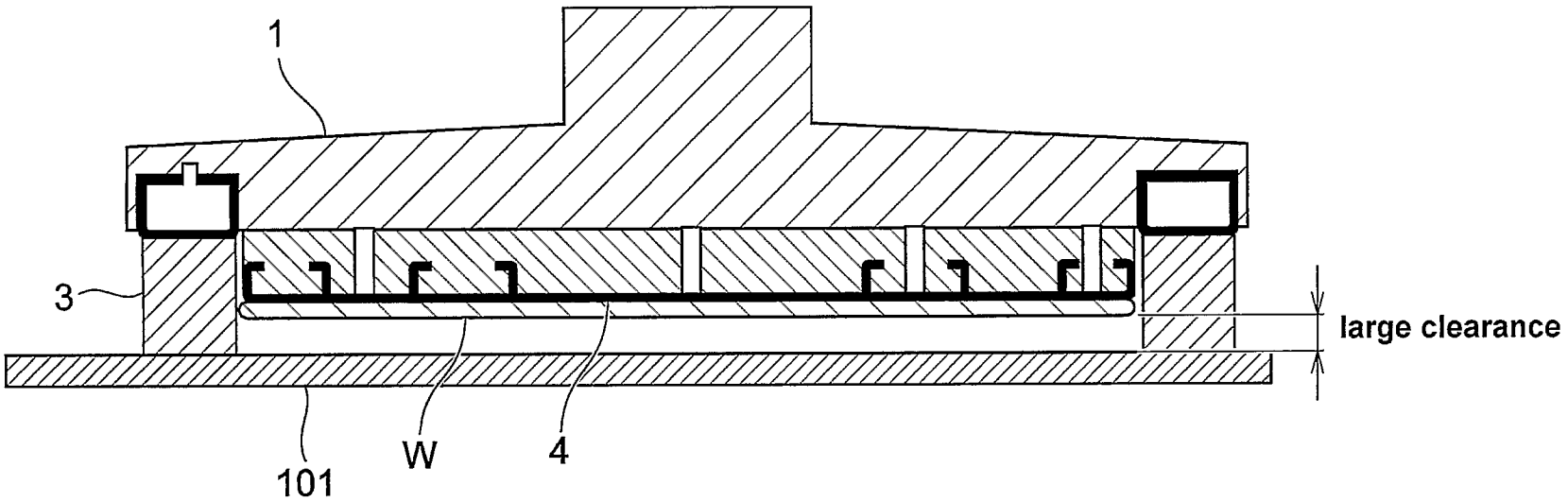
FIG. 11 is a view showing a second aspect of the present invention, and is a schematic view showing the case in which the top ring holding the wafer under vacuum is lowered and there is a large clearance between the wafer and the polishing pad.

FIG. 11 is a view showing a second aspect of the present invention, and is a schematic view showing the case in which the top ring 1 holding the wafer W under vacuum is lowered and there is a large clearance between the wafer W and the polishing pad 101. As shown in FIG. 11, in the second aspect of the present invention, the clearance between the wafer W and the polishing pad 101 is made large at the time of starting pressurization. Specifically, at the time of starting pressurization, the membrane height defined as a clearance between the wafer W and the polishing pad 101 is made large in a state in which the wafer W is vacuum-chucked to the membrane 4.

Figure 12A:
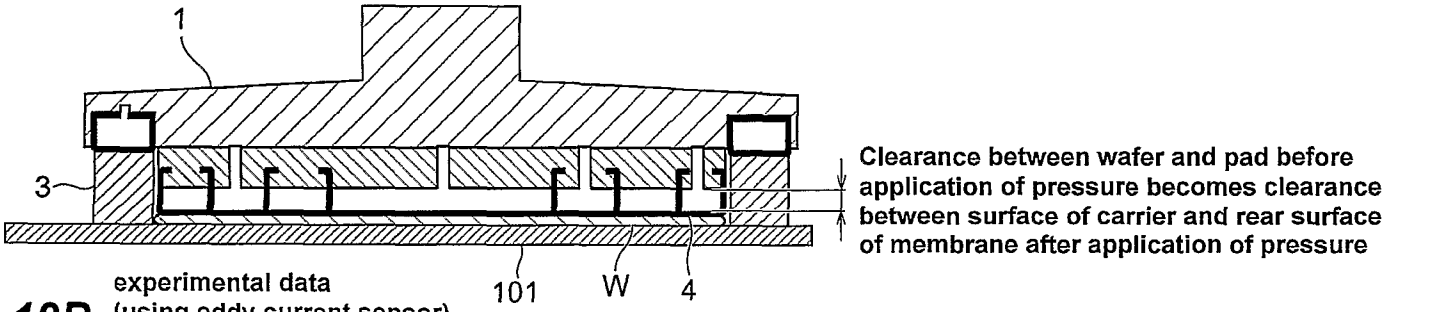
FIG. 12A is a schematic cross-sectional view showing the state in which application of the pressure to the membrane is started from the state of a high membrane height.
Figure 12B:
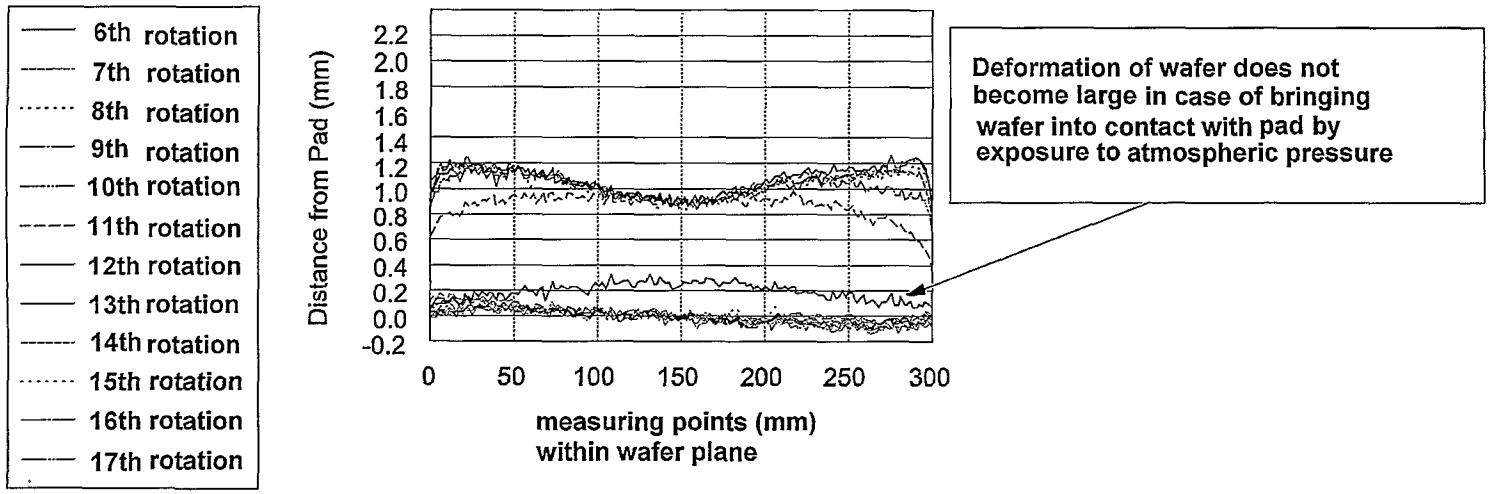
FIG. 12B is a graph showing deformation quantity of the wafer in the case where application of the pressure is started from the state of a large clearance between the wafer and the polishing pad.

FIG. 12A is a schematic cross-sectional view showing the state in which application of the pressure to the membrane is started from the state of a high membrane height. FIG. 12B is a graph showing deformation quantity of the wafer in the case where application of the pressure is started from the state of a large clearance between the wafer and the polishing pad. In FIG. 12B, the horizontal axis represents measuring points (mm) within the wafer plane in 300 mm Wafer, and the vertical axis represents distances from the polishing pad to the wafer obtained every time one revolution of the polishing table is performed when the eddy current sensor provided on the polishing table scans the lower surface (surface to be polished) of the wafer by rotation of the polishing table. As shown in FIG. 12A, the pressure is applied to the membrane from the state of a high membrane height at a low pressure, and the wafer W is brought into contact with the polishing pad 101 and pressed against the polishing pad 101. At this time, the membrane is expanded by an amount corresponding to the clearance between the wafer and the polishing pad, and the clearance between the wafer and the polishing pad no longer exists. Instead, a clearance between the lower surface of the carrier and the upper surface of the membrane is formed. Even if the clearance between the wafer and the polishing pad (equal to a membrane height defined as a clearance between the wafer W and the polishing pad 101 in a state in which the wafer W is vacuum-chucked to the membrane 4) when application of the pressure is started is large, the deformation quantity of the wafer can be small by pressurizing the membrane at a low pressure to bring the wafer into contact with the polishing pad.

In this case, the low pressure means a pressure of not more than a membrane pressure at the time of substantial polishing, and it is desirable that such low pressure is less than half that at the time of the substantial polishing. Further, the substantial polishing process is referred to as a process of polishing for over twenty seconds, and plural substantial polishing processes may exist. During this substantial polishing process, a polishing liquid or chemical liquid is supplied onto the polishing pad, and the wafer (substrate) is pressed against the polishing surface and brought into sliding contact with the polishing surface, thereby polishing the wafer, or cleaning the wafer. Instead of pressurizing the membrane at a low pressure to bring the wafer into contact with the polishing pad, the membrane is exposed to atmospheric pressure to bring the wafer into contact with the polishing pad, so that the deformation quantity of the wafer can be small. From experimental data of FIG. 12B, the state in which the wafer is not deformed in the process of pressing the wafer W against the polishing pad 101 after starting pressurization can be traced.

Figure 13:
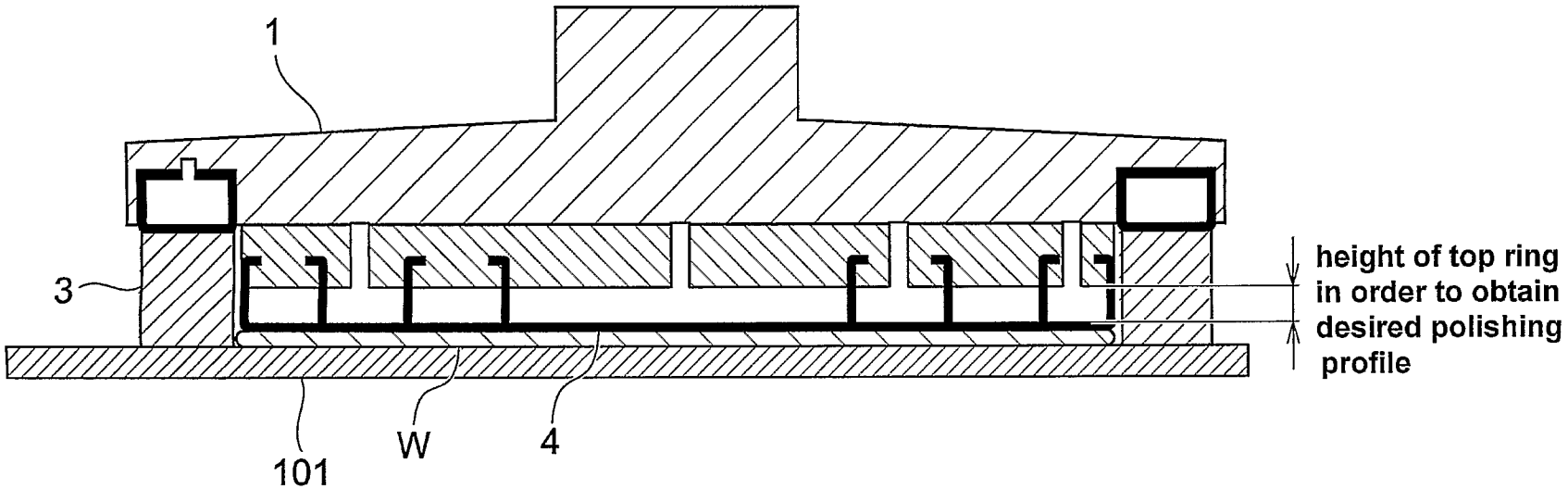
FIG. 13 is a schematic view showing the case in which a substantial polishing is performed in the state shown in FIG. 12A without moving the top ring.

FIG. 13 is a schematic view showing the case in which the substantial polishing is performed in the state shown in FIG. 12A without moving the top ring 1. According to the method shown in FIGS. 12A and 13, it is possible to perform polishing of the wafer without changing the top ring height between at the time of starting pressurization and at the time of the substantial polishing subsequent to the starting pressurization, i.e. between the successive steps. As described above, after the wafer is brought into contact with the polishing pad by pressurizing the membrane at a low pressure or allowing the membrane to be exposed to atmospheric pressure, the membrane is pressurized at a pressure of the substantial polishing, thereby polishing the wafer.

According to the present invention, as a method for detecting contact of the wafer W with the polishing pad 101 or a method for detecting pressing of the wafer W against the polishing pad 101, an optical reflection intensity measuring device or an eddy current sensor provided in the polishing table 100 may be used, or current value change of the table rotating motor may be used by utilizing a change of a rotating torque of the polishing table 100. Further, the current value change of the top ring rotating motor or the current value change of the ball screw driving motor for lifting and lowering the top ring may be used. Furthermore, after the wafer is brought into contact with the polishing pad, a volume increase of the membrane does not occur, and thus pressure change or flow rate change of the pressurized fluid for the membrane may be used.

In the above embodiments, although the first and second aspects of the present invention have been described separately, the membrane may be pressurized at a low pressure from the state of a small clearance between the wafer and the polishing pad, for example, a clearance of 0.2 mm.

(2) At the Time of Vacuum-Chucking the Wafer

After completing wafer processing on the polishing pad 101, the wafer W is vacuum-chucked to the top ring 1, and the top ring 1 is lifted and is then moved to a substrate transfer apparatus (pusher) where the wafer W is removed from the top ring 1. In this case, vacuum-chucking of the wafer is performed at a vacuum pressure of about −10 kPa in the center chamber 5 and about −80 kPa in the ripple chamber 6.

Figure 14:
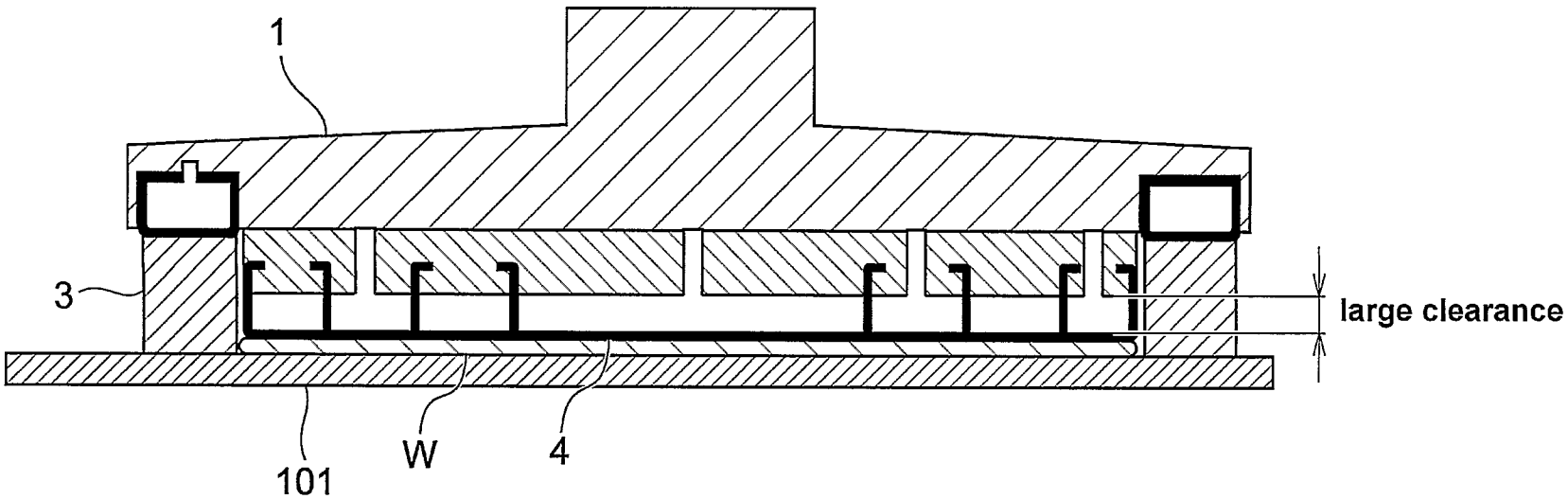
FIG. 14 is a schematic view showing the case in which after completing the wafer processing on the polishing pad and when the wafer is vacuum-chucked to the top ring, there is a large clearance between the surface of the carrier and the rear face of the membrane.
Figure 15:
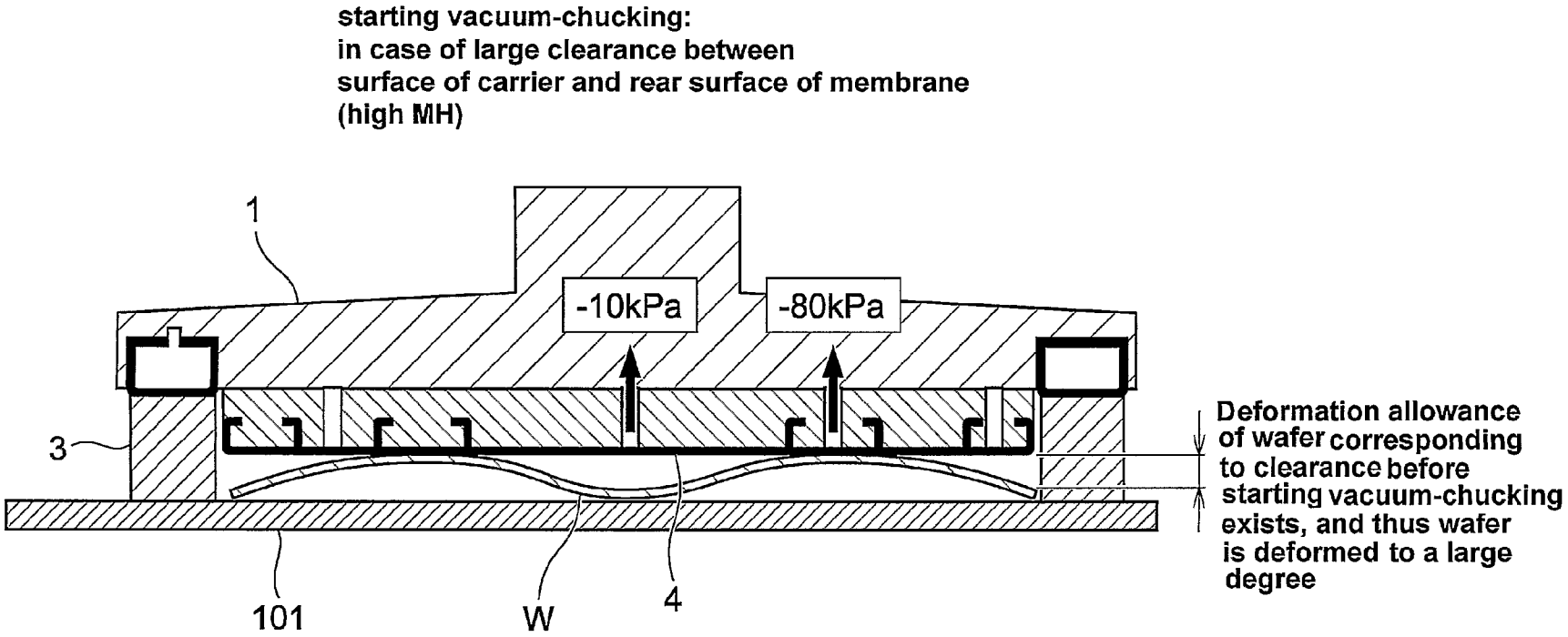
FIG. 15 is a schematic view showing deformation state of the wafer in the case where vacuum-chucking of the wafer is started from the state in which there is a large clearance between the surface of the carrier and the rear face of the membrane as shown in FIG. 14.
Figure 16:
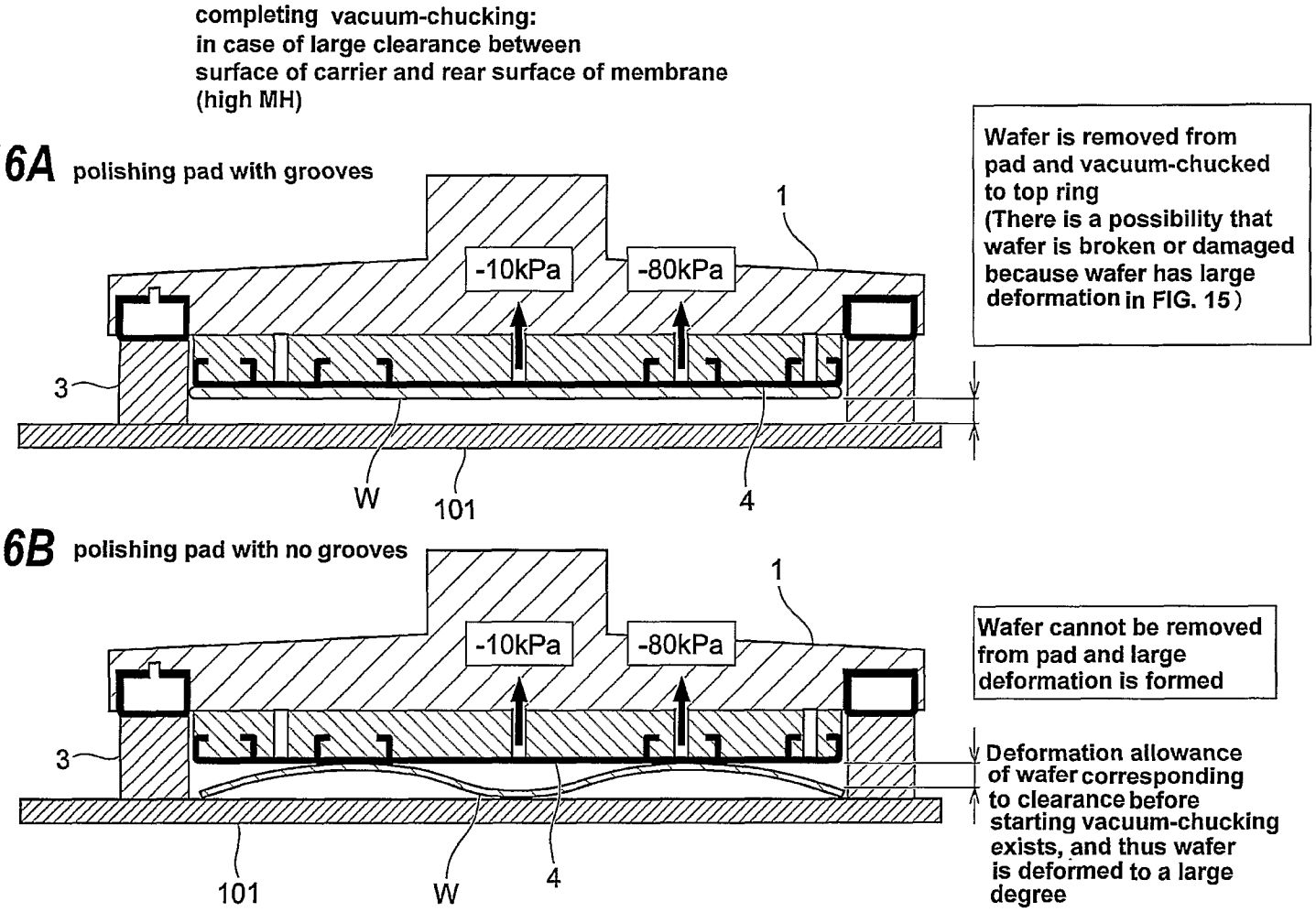
FIG. 16A is a schematic view showing the state of the wafer in the case where vacuum-chucking of the wafer is started from the state of a large clearance between the surface of the carrier and the rear face of the membrane and showing the case in which the polishing pad has grooves.
FIG. 16B is a schematic view showing the state of the wafer in the case where vacuum-chucking of the wafer is started from the state of a large clearance between the surface of the carrier and the rear face of the membrane and showing the case in which the polishing pad has no grooves.

FIG. 14 is a schematic view showing the case in which after completing the wafer processing on the polishing pad and when the wafer W is vacuum-chucked to the top ring 1, there is a large clearance between the surface of the carrier and the rear face of the membrane (the membrane height is high). FIG. 15 is a schematic view showing deformation state of the wafer in the case where vacuum-chucking of the wafer is started from the state in which there is a large clearance between the surface of the carrier and the rear face of the membrane as shown in FIG. 14. In the example shown in FIG. 15, there is deformation allowance of the wafer corresponding to the clearance before starting vacuum-chucking of the wafer, and thus the wafer is deformed to a large degree.

FIGS. 16A and 16B are schematic views showing the state of the wafer in the case where vacuum-chucking of the wafer is started from the state of a large clearance between the surface of the carrier and the rear face of the membrane. FIG. 16A shows the case in which the polishing pad has grooves, and FIG. 16B shows the case in which the polishing pad has no grooves. As shown in FIG. 16A, in the case of the polishing pad with grooves, the wafer W is removed from the polishing pad 101 and is vacuum-chucked to the top ring 1. However, as shown in FIG. 15, the wafer has large deformation immediately after the wafer is vacuum-chucked to the top ring, and hence there is a possibility that the wafer is broken or damaged. As shown in FIG. 16B, in the case of the polishing pad with no grooves, the wafer W cannot be removed from the polishing pad 101 and large deformation of the wafer W is formed. In the example shown in FIG. 16B, there is deformation allowance of the wafer corresponding to the clearance before starting vacuum-chucking of the wafer, and thus the wafer is deformed to a large degree.

Figure 17:
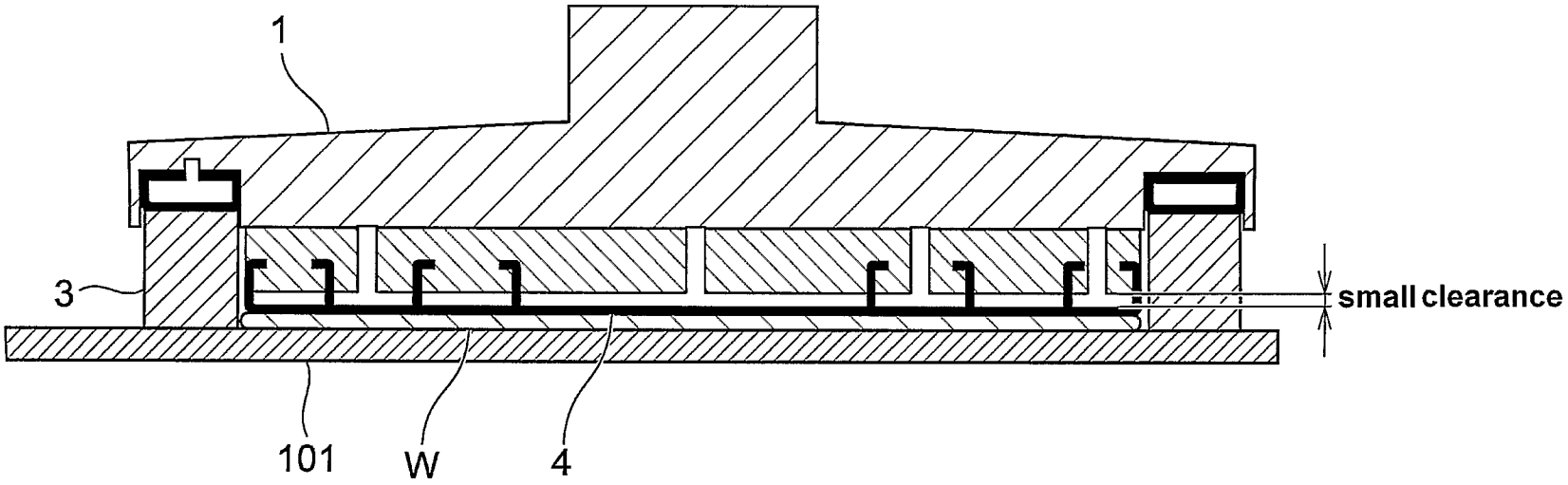
FIG. 17 is a view showing one aspect of the present invention, and is a schematic view showing the case in which after completing the wafer processing on the polishing pad and when the wafer is vacuum-chucked to the top ring, there is a small clearance between the surface of the carrier and the rear face of the membrane (the membrane height is low)
Figure 18:
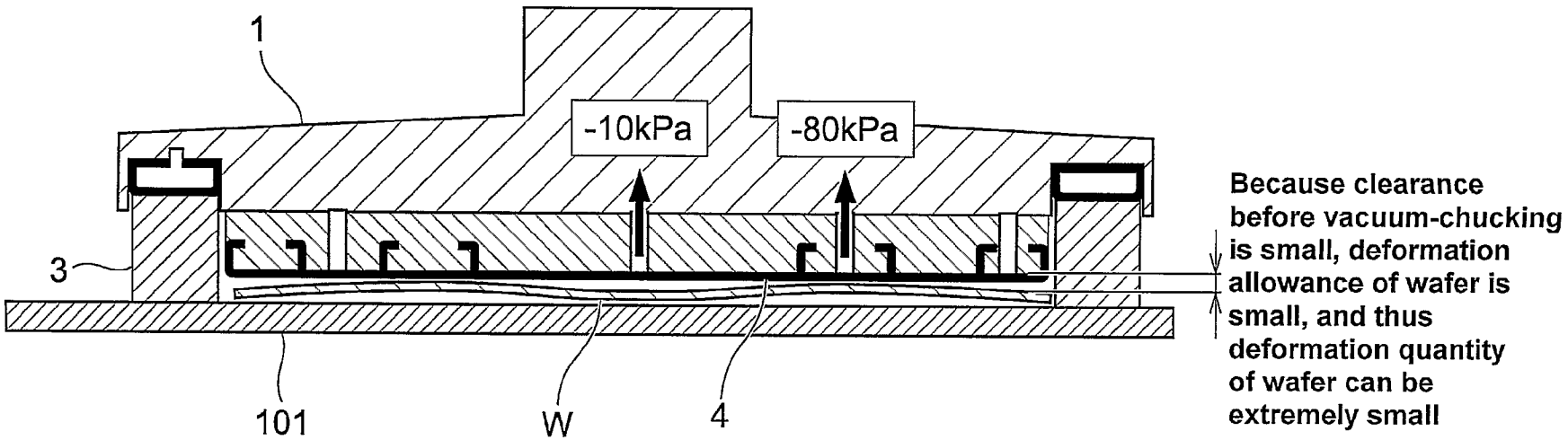
FIG. 18 is a schematic view showing deformation state of the wafer in the case where vacuum-chucking of the wafer is started from the state in which there is a small clearance between the surface of the carrier and the rear face of the membrane as shown in FIG. 17.

FIG. 17 is a view showing one aspect of the present invention, and a schematic view showing the case in which after completing the wafer processing on the polishing pad and when the wafer W is vacuum-chucked to the top ring 1, there is a small clearance between the surface of the carrier and the rear face of the membrane (the membrane height is low). FIG. 18 is a schematic view showing deformation state of the wafer in the case where vacuum-chucking of the wafer is started from the state in which there is a small clearance between the surface of the carrier and the rear face of the membrane as shown in FIG. 17. In the example shown in FIG. 18, because the clearance before vacuum-chucking of the wafer is small, deformation allowance of the wafer is small, and thus the deformation quantity of the wafer can be extremely small.

As described above, the substantial polishing process and the cleaning process such as water polishing are carried out in a state in which the membrane height, defined as a clearance between the top ring body (carrier) 2 and the membrane 4 with the wafer W being pressed against the polishing pad 101, is in the range of 0.1 mm to 1.2 mm. Then, at the time of vacuum-chucking of the wafer, it is desirable that the top ring should be moved so that the membrane height becomes in the range of 0.1 mm to 0.4 mm. When the top ring vacuum-chucks the wafer and removes the wafer from the polishing pad, the polishing surface and the wafer are spaced with a small clearance. Therefore, a liquid supplied to the polishing surface flows through the clearance and presents obstacles to removal of the wafer from the polishing surface. Accordingly, when the top ring exerts an attracting force onto the wafer, an amount of the liquid to be supplied to the polishing surface is reduced to allow air to enter between the wafer and the polishing surface, thereby reducing a suction force for pulling the wafer toward the polishing surface, i.e. reducing a negative pressure produced between the wafer and the polishing surface. In order to decrease the deformation quantity of the wafer, a vacuum pressure at the time of vacuum-chucking of the wafer may be in the range of −30 kPa to −80 kPa so as to produce a weak suction force. Further, by reducing stress applied to the wafer and the deformation quantity of the wafer at the time of vacuum-chucking of the wafer, it is possible to reduce a defect of the wafer such as residual abrasive grains on the wafer.

FIGS. 19A and 19B are schematic views showing the state in which vacuum-chucking of the wafer W to the top ring 1 has been completed. FIG. 19A shows the case in which the polishing pad has grooves, and FIG. 19B shows the case in which the polishing pad has no grooves. As shown in FIG. 19A, in the case of the polishing pad with grooves, because the clearance before vacuum-chucking of the wafer is small, deformation allowance of the wafer is small, and thus the wafer can be vacuum-chucked to the top ring without causing deformation of the wafer. As shown in FIG. 19B, in the case of the polishing pad with no grooves, generally, the wafer is not removed from the polishing pad before completing an overhang operation of the top ring. However, since deformation allowance is small, the deformation quantity of the wafer can be extremely small. That is, the wafer can be vacuum-chucked to the top ring without causing deformation of the wafer.

Figure 20:
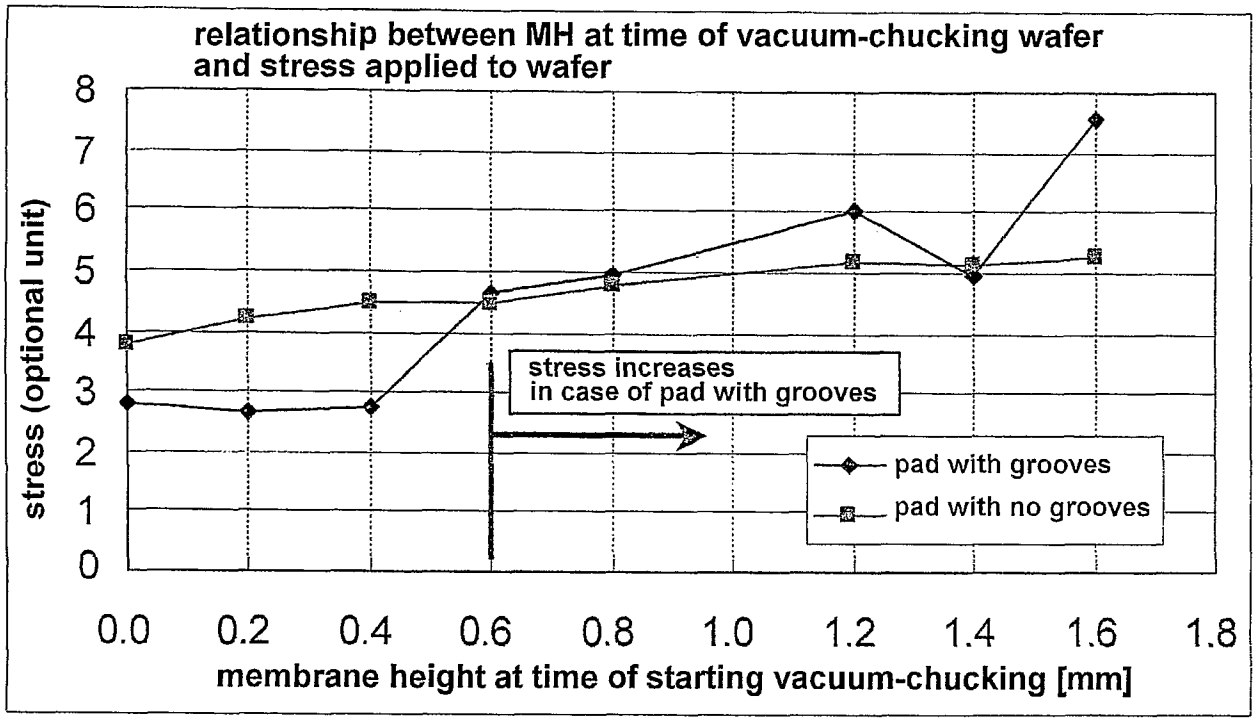
FIG. 20 is a graph showing experimental data, and is a graph showing the relationship between the membrane height (clearance between the lower surface of the carrier and the upper surface of the membrane) at the time of vacuum-chucking of the wafer and stress applied to the wafer at the time of vacuum-chucking of the wafer.

FIG. 20 is a graph showing experimental data, and is a graph showing the relationship between the membrane height (clearance between the lower surface of the carrier and the upper surface of the membrane) at the time of vacuum-chucking of the wafer and stress applied to the wafer at the time of vacuum-chucking of the wafer. In FIG. 20, the horizontal axis represents a membrane height (mm) at the time of starting vacuum-chucking of the wafer, and the vertical axis represents stress applied to the wafer at the time of vacuum-chucking of the wafer. FIG. 20 shows the case in which the polishing pad has grooves, and the case in which the polishing pad has no grooves. As is apparent from FIG. 20, in the case of the polishing pad with grooves, if the membrane height becomes not less than 0.6 mm, then the deformation quantity of the wafer at the time of vacuum-chucking of the wafer becomes large. Accordingly, stress applied to the wafer increases. In the case of the polishing pad with no grooves, since the wafer cannot be removed from the polishing pad at the time of vacuum-chucking of the wafer, stress applied to the wafer gradually increases as the membrane height increases.

(3) At the Time of Releasing of the Wafer

After completing wafer processing on the polishing pad 101, the wafer W is vacuum-chucked to the top ring 1, and the top ring 1 is lifted and is then moved to a substrate transfer apparatus (pusher) where the wafer W is removed from the top ring 1.

Figure 21:
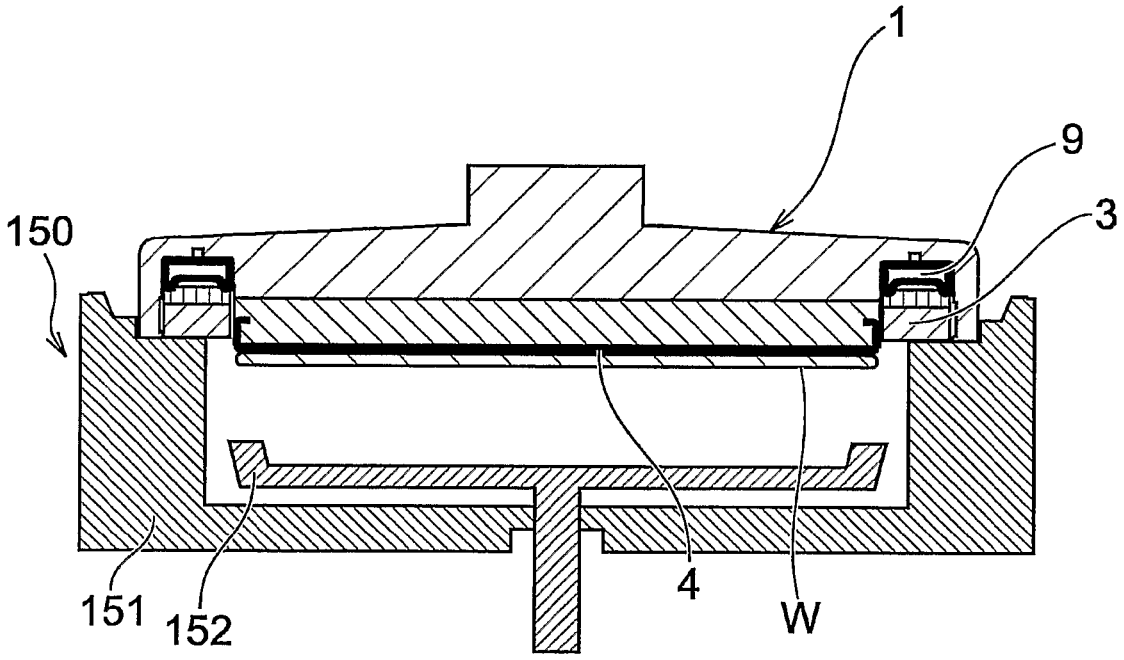
FIG. 21 is a schematic view showing the top ring and a pusher, and is the view showing the state in which the pusher is elevated in order to transfer the wafer from the top ring to the pusher.

FIG. 21 is a schematic view showing the top ring 1 and a pusher 150, and is the view showing the state in which the pusher is elevated in order to transfer the wafer from the top ring 1 to the pusher 150. As shown in FIG. 21, the pusher 150 comprises a top ring guide 151 capable of being fitted with the outer peripheral surface of the retainer ring 3 for centering the top ring 1, a pusher stage 152 for supporting the wafer when the wafer is transferred between the top ring 1 and the pusher 150, an air cylinder (not shown) for vertically moving the pusher stage 152, and an air cylinder (not shown) for vertically moving the pusher stage 152 and the top ring guide 151.

Next, operation of transfer of the wafer W from the top ring 1 to the pusher 150 will be described in detail. After the top ring 1 is moved above the pusher 150, the pusher stage 152 and the top ring guide 151 of the pusher 150 are lifted, and the top ring guide 151 is fitted with the outer peripheral surface of the retainer ring 3 to perform centering of the top ring 1 and the pusher 150. At this time, the top ring guide 151 pushes the retainer ring 3 up, and at the same time, vacuum is created in the retainer ring chamber 9, thereby lifting the retainer ring 3 quickly. Then, when lifting of the pusher is completed, the bottom surface of the retainer ring 3 is pushed by the upper surface of the top ring guide 151 and is thus located at a vertical position higher than the lower surface of the membrane 4. Therefore, a boundary between the wafer and the membrane is exposed. In the example shown in FIG. 21, the bottom surface of the retainer ring 3 is located at a position higher than the lower surface of the membrane by 1 mm. Thereafter, vacuum-chucking of the wafer W to the top ring 1 is stopped, and wafer release operation is carried out. Instead of lifting of the pusher, the top ring may be lowered to arrange a desired positional relationship between the pusher and the top ring.

Figure 22:
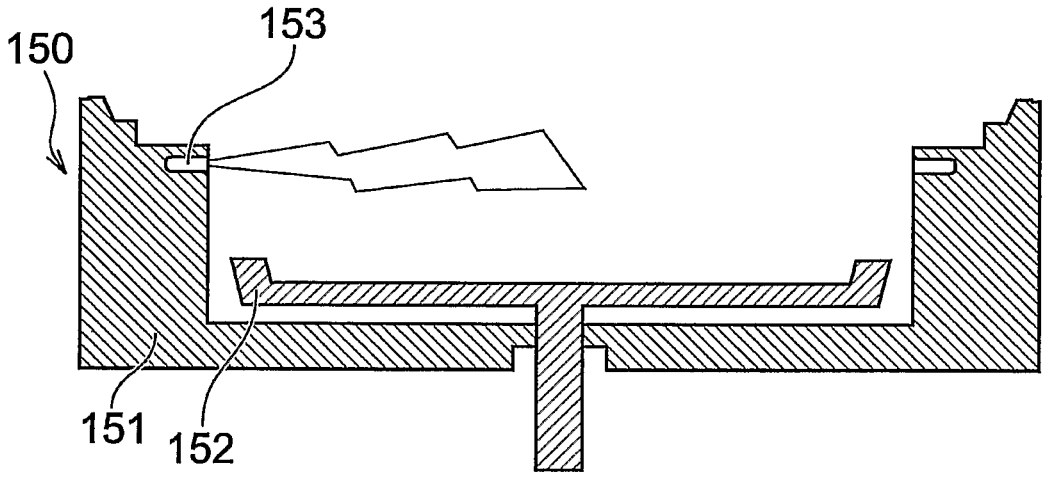
FIG. 22 is a schematic view showing a detailed structure of the pusher.

FIG. 22 is a schematic view showing a detailed structure of the pusher 150. As shown in FIG. 22, the pusher 150 has the top ring guide 151, the pusher stage 152, and release nozzles 153 formed in the top ring guide 151 for ejecting a fluid. A plurality of release nozzles 153 are provided at certain intervals in a circumferential direction of the top ring guide 151 to eject a mixed fluid of pressurized nitrogen and pure water in a radially inward direction of the top ring guide 151. Thus, a release shower comprising the mixed fluid of pressurized nitrogen and pure water is ejected between the wafer W and the membrane 4, thereby performing wafer release for removing the wafer from the membrane.

Figure 23:
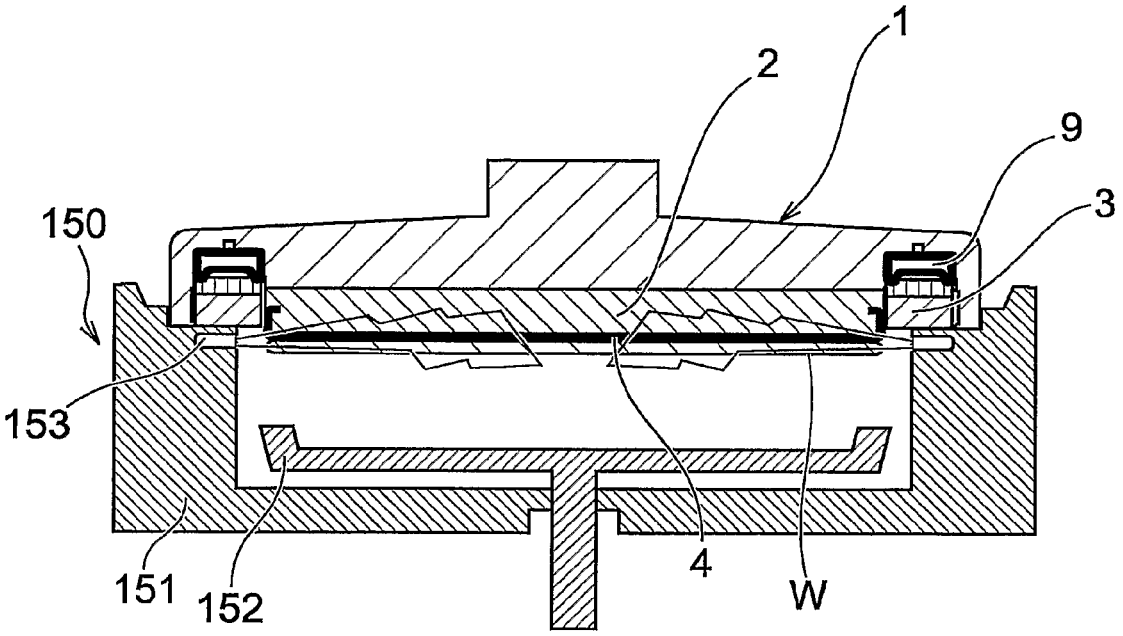
FIG. 23 is a schematic view showing the state of the wafer release for removing the wafer from the membrane.

FIG. 23 is a schematic view showing the state of the wafer release for removing the wafer from the membrane. As shown in FIG. 23, because a boundary between the wafer W and the membrane 4 is exposed, it is possible to eject the release shower between the wafer and the membrane 4 from the release nozzles 153 in a state of exposure of the membrane 4 to atmospheric pressure without pressurizing the membrane 4, i.e. without applying stress to the wafer W. Although the mixed fluid of pressurized nitrogen and pure water is ejected from the release nozzles 153, only a pressurized gas or a pressurized liquid may be ejected from the release nozzles 153. Further, a pressurized fluid of other combination may be ejected from the release nozzles 153. In some cases, adhesive force between the membrane and the rear surface of the wafer is strong depending on the condition of the rear surface of the wafer, and the wafer is difficult to be removed from the membrane. In such cases, the ripple area (ripple chamber 6) should be pressurized at a low pressure of not more than 0.1 MPa to assist removal of the wafer.

Figure 24B:
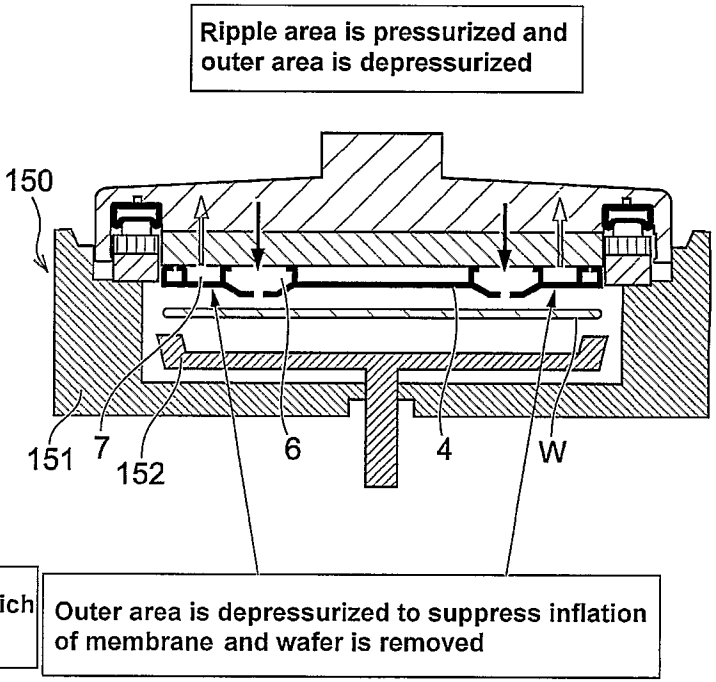
FIG. 24B is a schematic view showing the case in which the ripple area is pressurized when the wafer is removed from the membrane and showing the case in which the ripple area is pressurized and the outer area is depressurized.
Figure 24A:
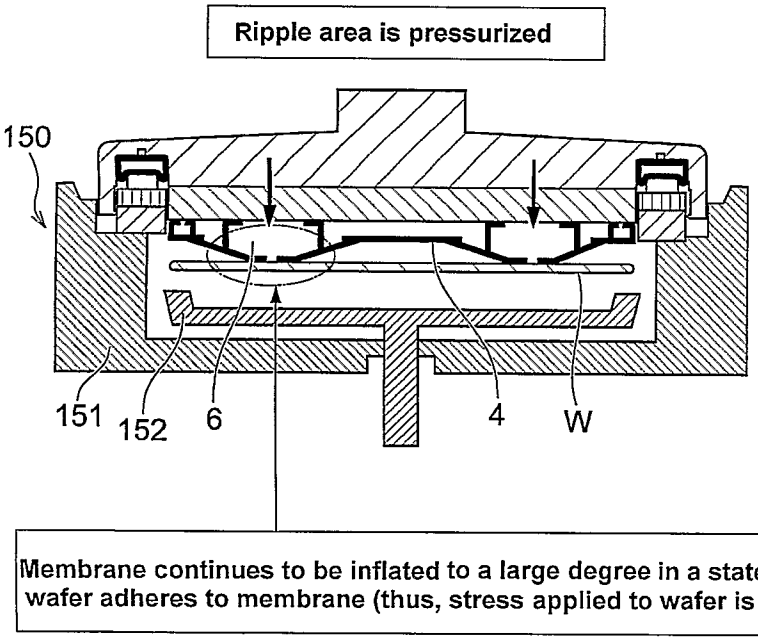
FIG. 24A is a schematic view showing the case in which a ripple area is pressurized when the wafer is removed from the membrane and showing the case in which the ripple area is pressurized.

FIGS. 24A and 24B are schematic views showing the case in which the ripple area is pressurized when the wafer is removed from the membrane. FIG. 24A shows the case in which the ripple area is pressurized, and FIG. 24B shows the case in which the ripple area is pressurized and the outer area is depressurized. As shown in FIG. 24A, when the ripple area (ripple chamber 6) is pressurized, the membrane 4 continues to be inflated to a large degree in a state in which the wafer W adheres to the membrane 4 (thus, stress applied to the wafer is large). Then, as shown in FIG. 24B, in the case where the ripple area (ripple chamber 6) is pressurized, in order to prevent the membrane from continuing to be inflated in a state in which the wafer W adheres to the membrane 4, the area other than the ripple area is depressurized to suppress inflation of the membrane 4. In the example shown in FIG. 24B, the outer area (outer chamber 7) is depressurized.

Next, a specific structure of a top ring 1 which is suitably used in the present invention will be described below in detail. FIGS. 25 through 29 are cross-sectional views showing the top ring 1 along a plurality of radial directions of the top ring 1. FIGS. 25 through 29 are views showing the top ring 1 shown in FIG. 2 in more detail. As shown in FIGS. 25 through 29, the top ring 1 has a top ring body 2 for pressing a semiconductor wafer W against the polishing surface 101*a*, and a retainer ring 3 for directly pressing the polishing surface 101*a*. The top ring body 2 includes an upper member 300 in the form of a circular plate, an intermediate member 304 attached to a lower surface of the upper member 300, and a lower member 306 attached to a lower surface of the intermediate member 304. The retainer ring 3 is attached to a peripheral portion of the upper member 300 of the top ring body 2. As shown in FIG. 26, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 2 including the upper member 300, the intermediate member 304, and the lower member 306 is made of resin such as engineering plastics (e.g. PEEK). The upper member 300 may be made of metal such as SUS or aluminium.

Figure 25:
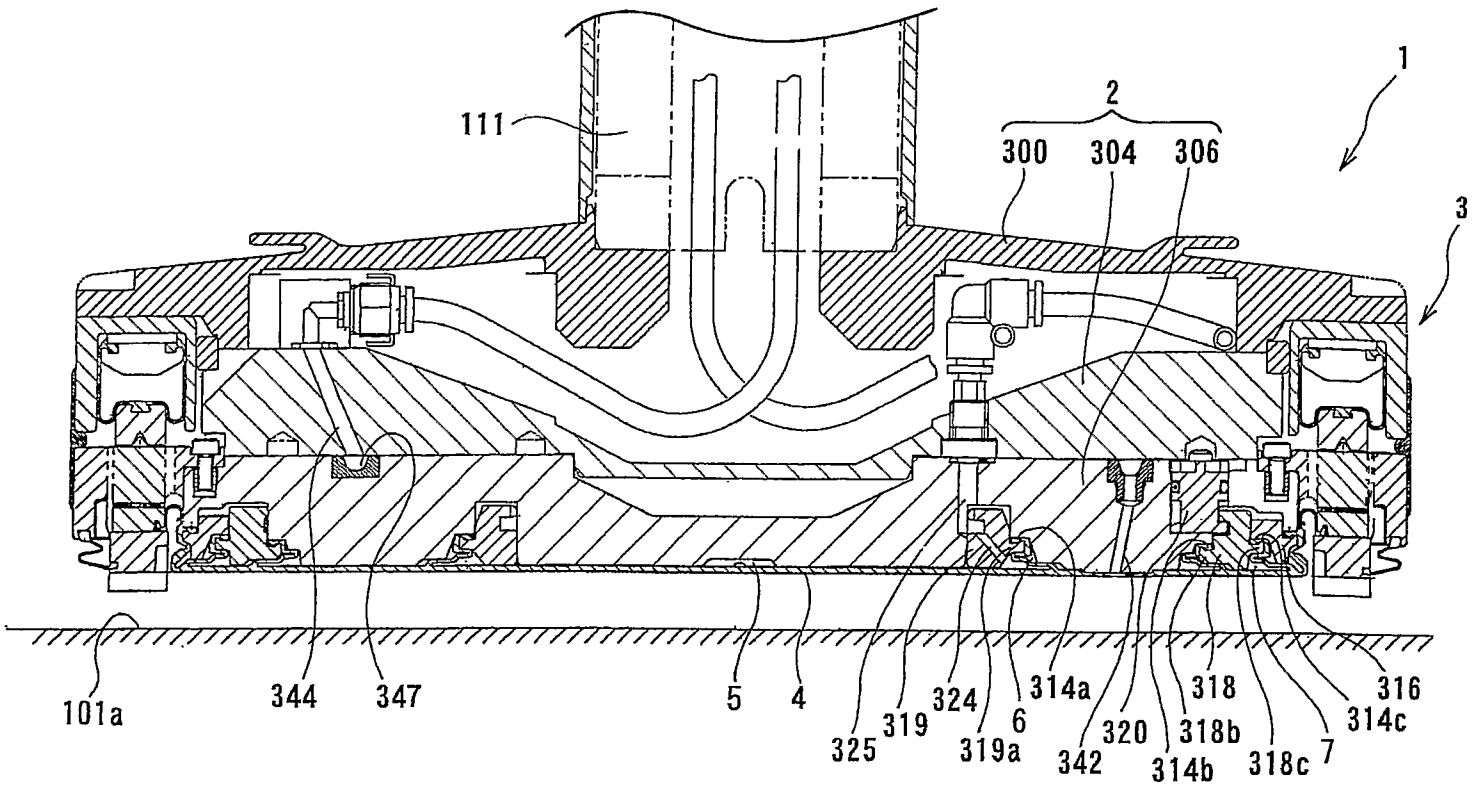
FIG. 25 is a view showing the top ring shown in FIG. 1 in more detail.
Figure 26:
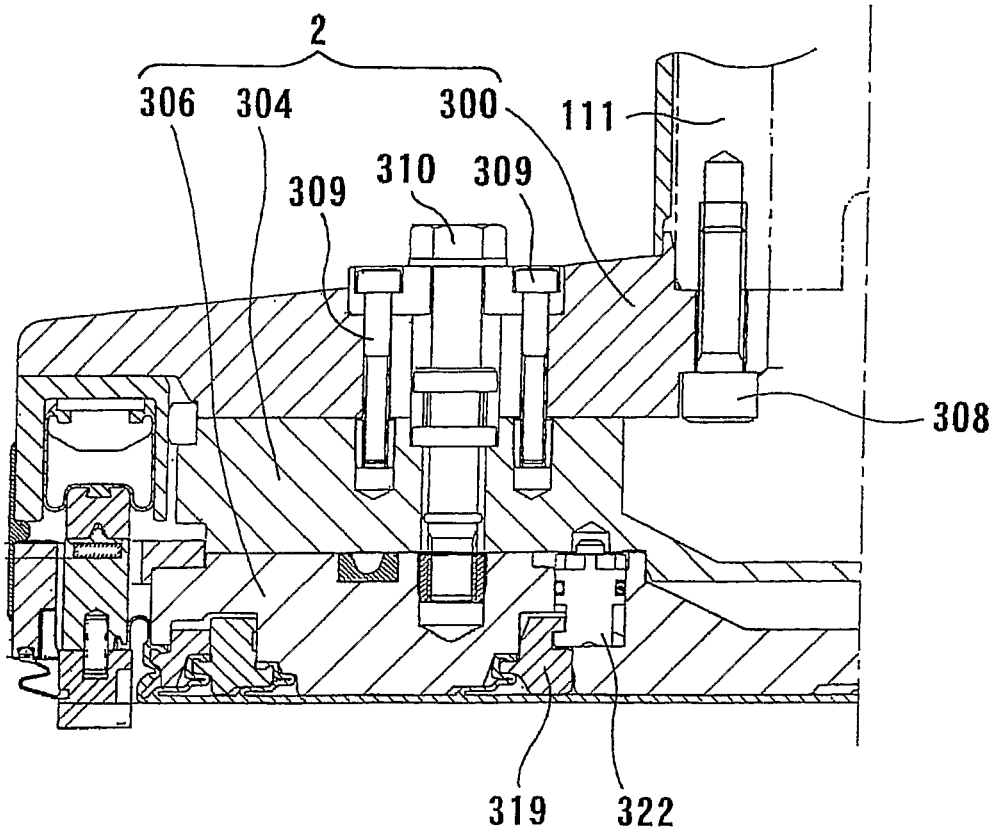
FIG. 26 is a cross-sectional view showing the top ring shown in FIG. 1 in more detail.

As shown in FIG. 25, the top ring 1 has an elastic membrane 4 attached to a lower surface of the lower member 306. The elastic membrane 4 is brought into contact with a rear face of a semiconductor wafer held by the top ring 1. The elastic membrane 4 is held on the lower surface of the lower member 306 by an annular edge holder 316 disposed radially outward and annular ripple holders 318 and 319 disposed radially inward of the edge holder 316. The elastic membrane 4 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 26, the ripple holder 319 is held on the lower surface of the lower member 306 by a plurality of stoppers 322. As shown in FIG. 13, the stoppers 320 and the stoppers 322 are arranged along a circumferential direction of the top ring 1 at equal intervals.

As shown in FIG. 25, a central chamber 5 is formed at a central portion of the elastic membrane 4. The ripple holder 319 has a passage 324 communicating with the central chamber 5. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 5 formed by the elastic membrane 4.

The ripple holder 318 has a claw 318*b* for pressing a ripple 314*b* of the elastic membrane 4 against the lower surface of the lower member 306. The ripple holder 319 has a claw 319*a* for pressing a ripple 314*a* of the elastic membrane 4 against the lower surface of the lower member 306. An edge 314*c* of the elastic membrane 4 is pressed by a claw 318*c* of the ripple holder 318 against the edge holder 316.

Figure 27:
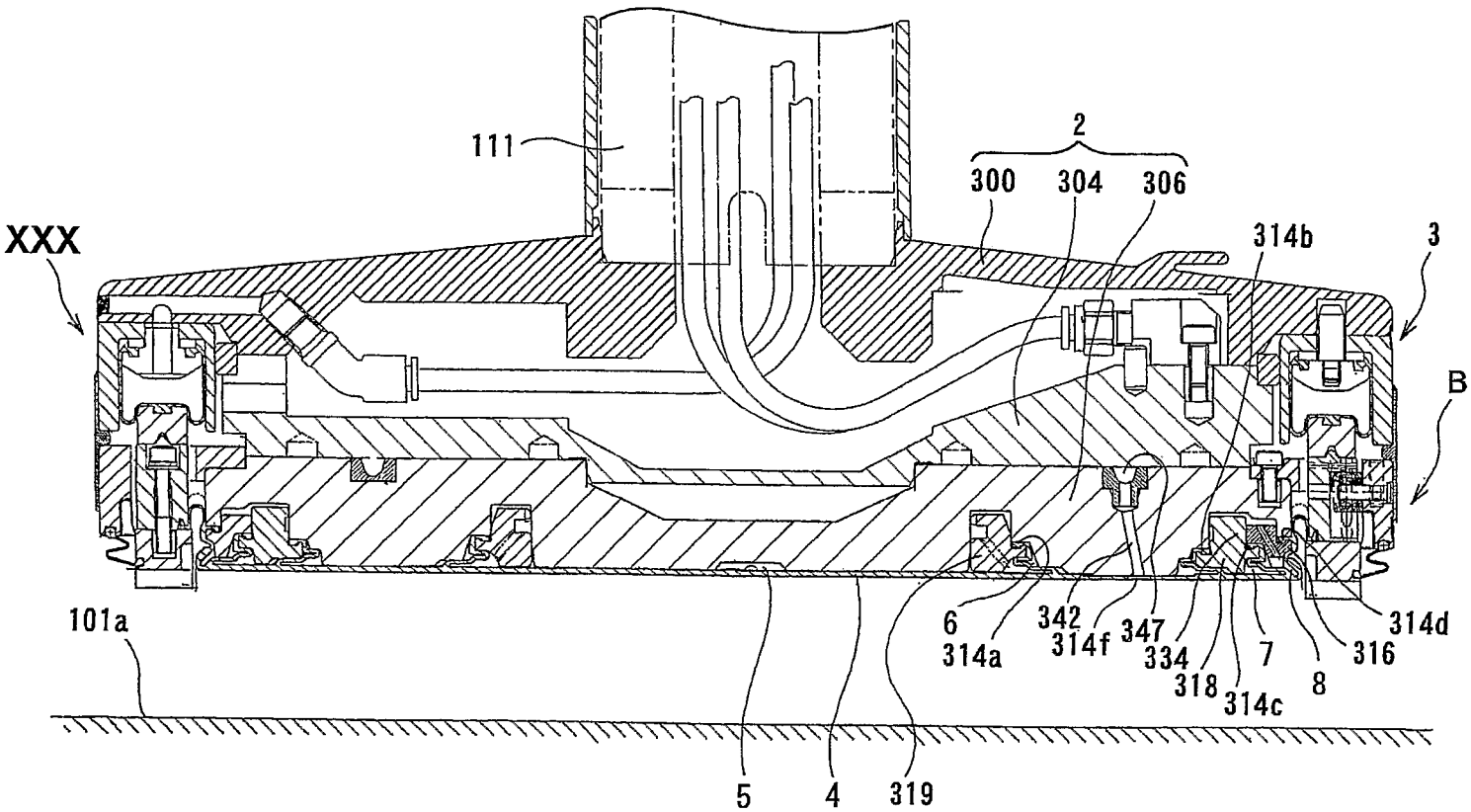
FIG. 27 is a cross-sectional view showing the top ring shown in FIG. 1 in more detail.

As shown in FIG. 27, an annular ripple chamber 6 is formed between the ripple 314*a* and the ripple 314*b* of the elastic membrane 4. A gap 314*f* is formed between the ripple holder 318 and the ripple holder 319 of the elastic membrane 4. The lower member 306 has a passage 342 communicating with the gap 314*f*. Further, as shown in FIG. 25, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through the passages to the ripple chamber 6. Further, the passage 342 is selectively connected to a vacuum pump (not shown). When the vacuum pump is operated, a semiconductor wafer is attached to the lower surface of the elastic membrane 4 by suction.

Figure 28:
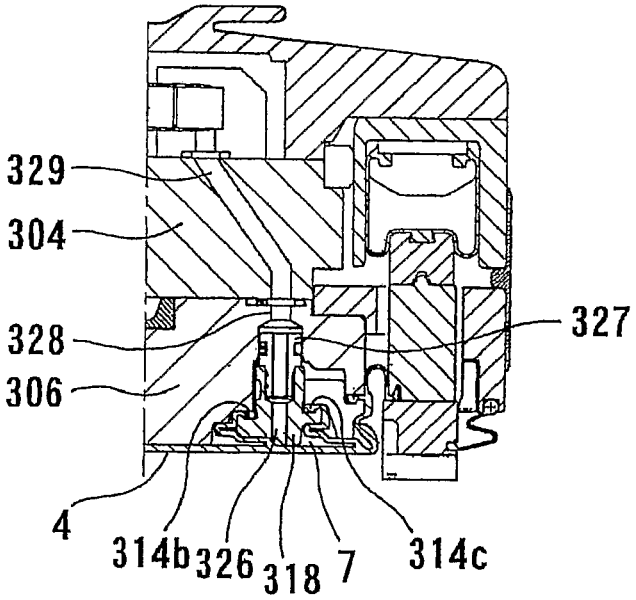
FIG. 28 is a cross-sectional view showing the top ring shown in FIG. 1 in more detail.

As shown in FIG. 28, the ripple holder 318 has a passage 326 communicating with an annular outer chamber 7 formed by the ripple 314*b* and the edge 314*c* of the elastic membrane 4. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through the passages 329, 328, and 326 to the outer chamber 7 formed by the elastic membrane 4.

Figure 29:
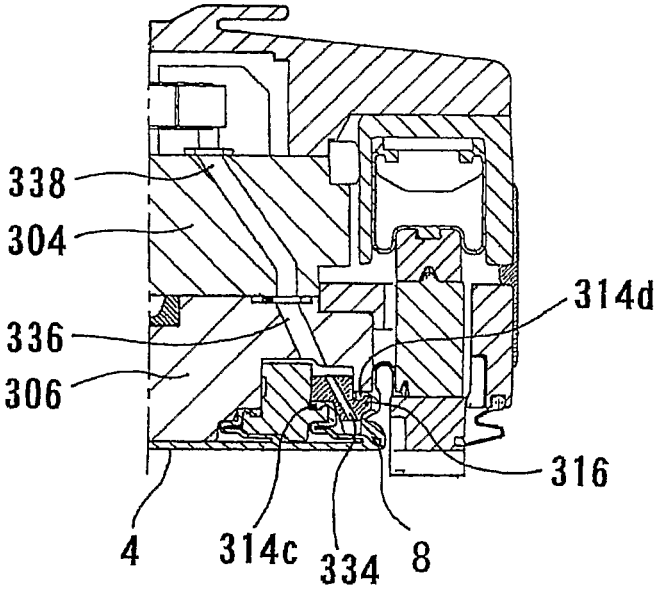
FIG. 29 is a cross-sectional view showing the top ring shown in FIG. 1 in more detail.

As shown in FIG. 29, the edge holder 316 has a claw for holding an edge 314*d* of the elastic membrane 4 on the lower surface of the lower member 306. The edge holder 316 has a passage 334 communicating with an annular edge chamber 8 formed by the edges 314*c* and 314*d* of the elastic membrane 4. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source. Thus, a pressurized fluid is supplied through the passages 338, 336, and 334 to the edge chamber 8 formed by the elastic membrane 4. The central chamber 5, the ripple chamber 6, the outer chamber 7, the edge chamber 8, and the retainer ring chamber 9 are connected to the fluid supply source through regulators R1 to R5 (not shown), and valves V1-1-V1-3, V2-1-V2-3, V3-1-V3-3, V4-1-V4-3 and V5-1-V5-3 (not shown) as with the embodiment shown in FIG. 2.

As described above, according to the top ring 1 in the present embodiment, pressing forces for pressing a semiconductor wafer against the polishing pad 101 can be adjusted at local areas of the semiconductor wafer by adjusting pressures of fluids to be supplied to the respective pressure chambers (i.e. the central chamber 5, the ripple chamber 6, the outer chamber 7, and the edge chamber 8) formed between the elastic membrane 4 and the lower member 306.

Figure 30:
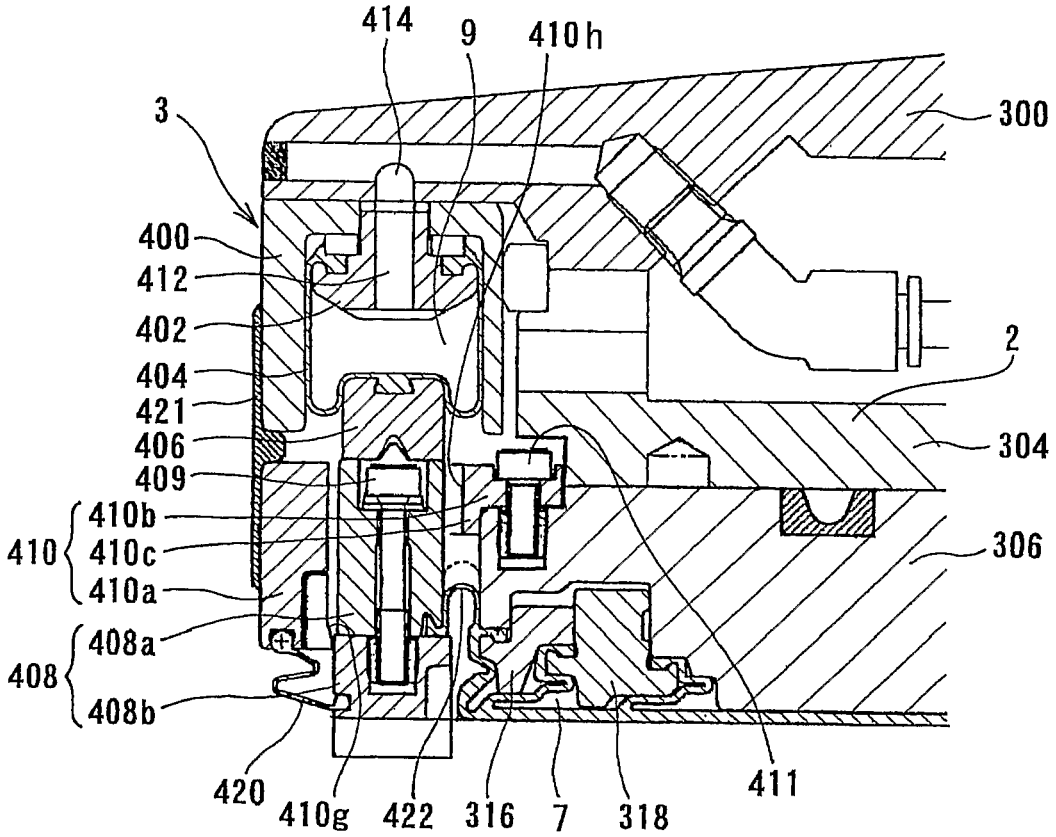
FIG. 30 is an enlarged view of XXX part of a retainer ring shown in FIG. 27.

FIG. 30 is an enlarged view of XXX part of the retainer ring shown in FIG. 27. The retainer ring 3 serves to hold a peripheral edge of a semiconductor wafer. As shown in FIG. 30, the retainer ring 3 has a cylinder 400 having a cylindrical shape, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 101*a*. The upper ring member 408*a* and the lower ring member 408*b* are coupled by a plurality of bolts 409. The upper ring member 408*a* is composed of a metal such as SUS or a material such as ceramics. The lower ring member 408*b* is composed of a resin material such as PEEK or PPS.

As shown in FIG. 30, the holder 402 has a passage 412 communicating with the retainer ring chamber 9 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through the passages 414 and 412 to the retainer ring chamber 9. Accordingly, by adjusting a pressure of a fluid to be supplied to the retainer ring chamber 9, the elastic membrane 404 can be expanded and contracted so as to vertically move the piston 406. Thus, the ring member 408 of the retainer ring 3 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, only the ring member 408 of the retainer ring 3 can be lowered. Accordingly, a pressing force of the retainer ring 3 can be maintained at a constant level by widening the space of the chamber 451 formed by the rolling diaphragm comprising an extremely low friction material even if the ring member 408 of the retainer ring 3 is worn out, without changing the distance between the lower member 306 and the polishing pad 101. Further, since the ring member 408, which is brought into contact with the polishing pad 101, and the cylinder 400 are connected by the deformable elastic membrane 404, no bending moment is produced by offset loads. Accordingly, surface pressures by the retainer ring 3 can be made uniform, and the retainer ring 3 becomes more likely to follow the polishing pad 101.

Further, as shown in FIG. 30, the retainer ring 3 has ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 of the top ring 1 by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*.

As shown in FIGS. 25 through 30, a connection sheet 420, which can be expanded and contracted in a vertical direction, is provided between an outer circumferential surface of the ring member 408 and a lower end of the retainer ring guide 410. The connection sheet 420 is disposed so as to fill a gap between the ring member 408 and the retainer ring guide 410. Thus, the connection sheet 420 serves to prevent a polishing liquid (slurry) from being introduced into the gap between the ring member 408 and the retainer ring guide 410. A band 421 comprising a belt-like flexible member is provided between an outer circumferential surface of the cylinder 400 and an outer circumferential surface of the retainer ring guide 410. The band 421 is disposed so as to cover a gap between the cylinder 400 and the retainer ring guide 410. Thus, the band 421 serves to prevent a polishing liquid (slurry) from being introduced into the gap between the cylinder 400 and the retainer ring guide 410.

The elastic membrane 4 includes a seal portion (seal member) 422 which connects the elastic membrane 4 to the retainer ring 3 at an edge (periphery) 314*d* of the elastic membrane 4. The seal portion 422 has an upwardly curved shape. The seal portion 422 is disposed so as to fill a gap between the elastic membrane 4 and the ring member 408. The seal portion 422 is preferably made of a deformable material. The seal portion 422 serves to prevent the polishing liquid from being introduced into the gap between the elastic membrane 4 and the retainer ring 3 while allowing the top ring body 2 and the retainer ring 3 to be moved relative to each other. In the present embodiment, the seal portion 422 is formed integrally with the edge 314*b* of the elastic membrane 4 and has a U-shaped cross-section.

If the connection sheet 420, the band 421 and the seal portion 422 are not provided, a polishing liquid, or a liquid for polishing an object may be introduced into an interior of the top ring 1 so as to inhibit normal operation of the top ring body 2 and the retainer ring 3 of the top ring 1. According to the present embodiment, the connection sheet 420, the band 421 and the seal portion 422 prevent a polishing liquid from being introduced into the interior of the top ring 1. Accordingly, it is possible to operate the top ring 1 normally. The elastic membrane 404, the connection sheet 420, and the seal portion 422 are made of a highly strong and durable rubber material such as ethylene propylene rubber (EPDM), polyurethane rubber, silicone rubber, or the like.

In the chucking plate floating-type top ring which has been heretofore used, if the retainer ring 3 is worn out, a distance between the semiconductor wafer and the lower member 306 is varied to change a deformation manner of the elastic membrane 4. Thus, surface pressure distribution is also varied on the semiconductor wafer. Such a variation of the surface pressure distribution causes unstable polishing profile of the polished semiconductor wafer.

According to the present embodiment, because the retainer ring 3 can vertically be moved independently of the lower member 306, a constant distance can be maintained between the semiconductor wafer and the lower member 306 even if the ring member 408 of the retainer ring 3 is worn out. Accordingly, the polishing profile of the semiconductor wafer can be stabilized.

Although certain preferred embodiments of the present invention have been shown and described in detail, it should be understood that various changes and modifications may be made therein without departing from the scope of the appended claims.

INDUSTRIAL APPLICABILITY

The present invention is applicable to a method and apparatus of polishing an object to be polished, or substrate, such as a semiconductor wafer to a flat mirror finish.

The invention claimed is:

1. A method of polishing a substrate by a polishing apparatus comprising a polishing table having a polishing surface, a top ring for holding a substrate and pressing the substrate against said polishing surface, and a vertically movable mechanism for moving said top ring in a vertical direction, wherein said top ring comprises at least one elastic membrane configured to form a pressure chamber to be supplied with a pressurized fluid, and a top ring body for holding said membrane, said membrane being configured to press the substrate against said polishing surface under a fluid pressure by supplying the pressurized fluid to said pressure chamber, said method comprising:

moving said top ring body and said membrane to a first height before the substrate is pressed against said polishing surface, wherein said first height is a height of said membrane that forms a clearance of 0.1 mm to 1.7 mm between the substrate and said polishing surface in a state in which the substrate is attached to and held by said membrane and a lower surface of said top ring body and an upper surface of said membrane are in contact with each other;

pressing the substrate against said polishing surface by supplying the pressurized fluid to said pressure chamber while maintaining said top ring body at said first height;

moving said top ring body to a second height while the substrate continues to be pressed against said polishing surface, wherein said second height is a height of said top ring body to form a clearance of 0.1 mm to 2.7 mm between said top ring body and said membrane in a state in which the substrate is pressed against said polishing surface by said membrane; and polishing the substrate in a state in which said top ring body is kept at the second height and the substrate is pressed against the polishing surface.

2. The method according to claim 1, wherein said first height is a height of said membrane that forms a clearance of 0.1 mm to 0.7 mm between the substrate and said polishing surface in a state in which the substrate is attached to and held by said membrane.

3. The method according to claim 1, wherein said second height is a height of said top ring body that forms a clearance of 0.1 mm to 1.2 mm between said top ring body and said membrane in a state in which the substrate is pressed against said polishing surface by said membrane.

4. The method according to claim 1, further comprising detecting a pressing of the substrate against said polishing surface.

5. The method according to claim 1, wherein said top ring body is moved to said second height after detecting a pressing of the substrate against said polishing surface.

6. The method according to claim 4, wherein at least one of current value change of a motor for rotating said polishing table, an eddy current sensor provided in said polishing table, an optical sensor provided in said polishing table, and current value change of a motor for rotating said top ring is used so as to detect the pressing of the substrate against said polishing surface.

7. The method according to claim 5, wherein at least one of current value change of a motor for rotating said polishing table, an eddy current sensor provided in said polishing table, an optical sensor provided in said polishing table, and current value change of a motor for rotating said top ring is used so as to detect the pressing of the substrate against said polishing surface.

8. The method according to claim 4, wherein said vertically movable mechanism for moving said top ring in a vertical direction comprises a ball screw and a motor for rotating said ball screw; and wherein current value change of said motor for rotating said ball screw is used so as to detect the pressing of the substrate against said polishing surface.

9. The method according to claim 4, wherein pressure change or flow rate change of the pressurized fluid supplied to said pressure chamber is used so as to detect the pressing of the substrate against said polishing surface.

10. The method according to claim 1, wherein said vertically movable mechanism comprises a ball screw for moving said top ring in a vertical direction and a motor for rotating said ball screw.

11. The method according to claim 10, wherein said vertically movable mechanism further comprises a mechanism including a sensor for measuring the height of said polishing surface.

12. A method of polishing a substrate by a polishing apparatus comprising a polishing table having a polishing surface, a top ring for holding a substrate and pressing the substrate against said polishing surface, and a vertically movable mechanism for moving said top ring in a vertical direction, wherein said top ring comprises at least one elastic membrane configured to form a pressure chamber to be supplied with a pressurized fluid, a top ring body for holding said membrane, and a retainer ring configured to hold a peripheral portion of the substrate and to be movable independently relative to said to ring body, said membrane being configured to press the substrate against said polishing surface under a fluid pressure by supplying the pressurized fluid to said pressure chamber, said method comprising:

moving said top ring body and said membrane to a predetermined height before the substrate is pressed against said polishing surface, wherein said predetermined height is a height of said membrane that forms a clearance of 0.1 mm to 1.2 mm between the substrate and said polishing surface in a state in which the substrate is attached to and held by said membrane and a lower surface of said top ring body and an upper surface of said membrane are in contact with each other;

applying a first pressure to said pressure chamber until the substrate is brought into contact with said polishing surface while maintaining said top ring body at said predetermined height; and applying a second pressure higher than said first pressure to said pressure chamber after the substrate is brought into contact with said polishing surface and when the substrate starts to be polished, and pressing the substrate against said polishing surface at said second pressure to polish the substrate, while maintaining said top ring body at said predetermined height.

13. The method according to claim 12, wherein said first pressure is not more than half of said second pressure in said polishing process.

14. The method according to claim 12, wherein said first pressure is an atmospheric pressure.

15. The method according to claim 12, further comprising a step of detecting the pressing of the substrate against said polishing surface.

16. The method according to claim 12, wherein the substrate is pressed against said polishing surface at said second pressure after detecting the pressing of the substrate against said polishing surface.

17. The method according to claim 15, wherein at least one of current value change of a motor for rotating said polishing table, an eddy current sensor provided in said polishing table, an optical sensor provided in said polishing table, and current value change of a motor for rotating said top ring is used so as to detect the pressing of the substrate against said polishing surface.

18. The method according to claim 16, wherein at least one of current value change of a motor for rotating said polishing table, an eddy current sensor provided in said polishing table, an optical sensor provided in said polishing table, and current value change of a motor for rotating said top ring is used so as to detect the pressing of the substrate against said polishing surface.

19. The method according to claim 15, wherein said vertically movable mechanism for moving said top ring in a vertical direction comprises a ball screw and a motor for rotating said ball screw; and wherein current value change of said motor for rotating said ball screw is used so as to detect the pressing of the substrate against said polishing surface.

20. The method according to claim 15, wherein pressure change or flow rate change of the pressurized fluid supplied to said pressure chamber is used so as to detect the pressing of the substrate against said polishing surface.

21. The method according to claim 12, wherein said vertically movable mechanism comprises a ball screw for moving said top ring in a vertical direction and a motor for rotating said ball screw.

22. The method according to claim 21, wherein said vertically movable mechanism further comprises a mechanism including a sensor for measuring the height of said polishing surface.

23. The method according to claim 12, wherein said moving of said top ring body and said membrane, said applying of said first pressure, and said applying of said second pressure are conducted in a state in which said retainer ring is brought in contact with said polishing surface.

24. A method of polishing a substrate by a polishing apparatus comprising a polishing table having a polishing surface, a top ring for holding a substrate and pressing the substrate against said polishing surface, and a vertically movable mechanism for moving said top ring in a vertical direction, wherein said top ring comprises at least one elastic membrane configured to form a pressure chamber to be supplied with a pressurized fluid, and a top ring body configured to hold said membrane, said membrane being configured to press the substrate against said polishing surface under a fluid pressure by supplying the pressurized fluid to said pressure chamber, said method comprising:

conducting a polishing process to obtain a polishing profile in a state in which said top ring body is maintained at a polishing height and said membrane presses the substrate against said polishing surface by the pressurized fluid supplied to said pressure chamber;

moving said top ring body from the polishing height to a predetermined height that is different than the polishing height in a state in which the substrate continues to be brought in contact with said polishing surface after the polishing process to obtain the polishing profile is finished, wherein said predetermined height is a height of said top ring body that forms a clearance of 0.1 mm and 1.7 mm between said top ring body and said membrane; and vacuum-chucking the substrate to said membrane from said polishing surface and holding the substrate by said membrane after said moving of said top ring body or simultaneously with said moving of said top ring body.

25. The method according to claim 24, wherein said predetermined height is a height of said top ring body that forms a clearance of 0.1 mm to 1.0 mm between said top ring body and said membrane.

26. The method according to claim 24, wherein said vertically movable mechanism comprises a ball screw for moving said top ring in a vertical direction and a motor for rotating said ball screw.

27. The method according to claim 26, wherein said vertically movable mechanism further comprises a mechanism including a sensor for measuring the height of said polishing surface.

28. The method according to claim 24, wherein said top ring further comprises a retainer ring; and wherein said conducting of the polishing process, said moving of said top ring body, and said vacuum-chucking of the substrate to said membrane are conducted in a state in which said retainer ring is brought in contact with said polishing surface.

29. The method according to claim 28, wherein said top ring is configured to move vertically independently of said retainer ring.

30. The method according to claim 24, wherein said predetermined height of said top ring body is lower than said polishing height of said top ring body.

* * * * *